US008190079B2

(12) United States Patent
Mohri

(10) Patent No.: US 8,190,079 B2
(45) Date of Patent: May 29, 2012

(54) IMAGE FORMING APPARATUS, PRINT CONTROL METHOD, AND COMPUTER PRODUCT

(75) Inventor: Kazuo Mohri, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 1152 days.

(21) Appl. No.: 12/003,137

(22) Filed: Dec. 20, 2007

(65) Prior Publication Data

US 2008/0166165 A1 Jul. 10, 2008

(30) Foreign Application Priority Data

Jan. 9, 2007 (JP) ..... 2007-001732

(51) Int. Cl.
*G03G 15/00* (2006.01)

(52) U.S. Cl. ..... 399/402; 399/401; 399/382; 399/397; 399/364

(58) Field of Classification Search ..... 399/397, 399/401, 402, 382
See application file for complete search history.

(56) References Cited

U.S. PATENT DOCUMENTS

| | | | | |
|---|---|---|---|---|
| 6,047,148 | A | 4/2000 | Nagatani et al. | |
| 7,444,115 | B2 * | 10/2008 | Fukada et al. | 399/401 |
| 2006/0197825 | A1 | 9/2006 | Mohri | |
| 2006/0269340 | A1 * | 11/2006 | Osari et al. | 399/401 |

FOREIGN PATENT DOCUMENTS

| | | |
|---|---|---|
| JP | 05-270111 | 10/1993 |
| JP | 06-344606 | 12/1994 |
| JP | 2005-084547 | 3/2005 |
| JP | 2005-221522 | 8/2005 |

OTHER PUBLICATIONS

Office Action dated Jun. 5, 2009 for corresponding Chinese Application No. 200810002853.3 and English translation thereof.
Office Action dated Jun. 7, 2011 for corresponding Japanese Application No. 2007-001732.

* cited by examiner

*Primary Examiner* — Daniel J Colilla
*Assistant Examiner* — Allister Primo
(74) *Attorney, Agent, or Firm* — Harness, Dickey & Pierce, P.L.C.

(57) ABSTRACT

An image forming apparatus includes an image forming unit, a conveyor unit, a printing unit, a data acquiring unit, and a control unit. The image forming unit forms an image based on image data. The conveyor unit conveys a transfer medium onto which the image is to be transferred. The printing unit prints the image onto the transfer medium. The data acquiring unit acquires the image data. The control unit controls the conveyor unit, the printing unit, and the data acquiring unit. The control unit controls the conveyor unit not to feed a transfer medium from a feed tray to the printing unit when a command for printing a second side by double-sided printing is not detected within a predetermined time after detecting a command for printing a first side by double-sided printing.

12 Claims, 15 Drawing Sheets

IMAGE FORMING APPARATUS, PRINT CONTROL METHOD, AND COMPUTER PRODUCT

CROSS-REFERENCE TO RELATED APPLICATIONS

The present application claims priority to and incorporates by reference the entire contents of Japanese priority document 2007-001732 filed in Japan on Jan. 9, 2007.

BACKGROUND OF THE INVENTION

1. Field of the Invention

The present invention relates to a technology for printing.

2. Description of the Related Art

A commonly-used image forming apparatus, including a copier and a printer, that is capable of printing on both sides of a transfer medium, such as paper, uses interleaf printing. The interleaf printing is a method of forming an image on a second side of the nth sheet and on a first side of the (n+2)th sheet alternately. For example, images are formed (printed) on recording sheets in the order of a first side of the first sheet, a first side of the second sheet, a second side of the first sheet, a first side of the third sheet, a second side of the second sheet, a first side of the forth sheet, and so on. In the Interleaf printing, a recording sheet is fed from a feed tray specified by a user upon printing its first side, and temporarily kept in a double-sided printing conveying path after the first side has been printed. Upon printing its second side, the recording sheet (whose first side has already been printed) is fed from the conveying path, where the sheet has been kept temporarily, printed with an image, and ejected from the image forming apparatus. Japanese Patent Application Laid-open No. 2005-084547 discloses an example of the double-sided image forming apparatus that forms an image using the interleaf printing method.

However, in the interleaf printing method, the (n+1)th recording sheet can be fed from the feed tray to have its first side printed, and conveyed to the conveying path, without a convey command being issued for the nth sheet in the conveying path, having its first side printed and waiting to have its second side printed. The convey command can be withheld due to delay in an image expanding process in a controller, for example, and cause collision of the nth recording sheet and the (n+1)th sheet, further causing a paper jam. Such collision can cause damage to rollers or gears conveying the recording sheets. Furthermore, the user is required to remove the collided sheets from the conveying path.

SUMMARY OF THE INVENTION

It is an object of the present invention to at least partially solve the problems in the conventional technology.

According to an aspect of the present invention, an image forming apparatus includes: an image forming unit that forms a toner image based on image data; a conveyor unit that conveys a transfer medium onto which the toner image is to be transferred; a printing unit that prints the toner image onto the transfer medium; a detecting unit that detects a print command for each image including information on printing mode including single-sided printing and double-sided printing; a data acquiring unit that acquires, when the detecting unit detects a print command for an image, image data of the image, and outputs the image data to the image forming unit; a first control unit that controls the conveyor unit to feed a transfer medium from a feed tray to the printing unit in response to a first print command for printing a first side by double-sided printing, and to feed the transfer medium to the printing unit from a conveying path, where the transfer medium is temporarily kept after the first side is printed, in response to a second print command for printing a second side by double-sided printing; and a second control unit that controls the conveyor unit to convey the transfer medium to the conveying path after the first side is printed, and to eject the transfer medium after the second side is printed. The first control unit controls the conveyor unit not to feed a transfer medium from the feed tray to the printing unit when the detecting unit does not detect the second print command within a predetermined time after detecting the first print command.

According to another aspect of the present invention, a print control method, which is applied to an image forming apparatus that includes an image forming unit that forms a toner image based on image data, a conveyor unit that conveys a transfer medium onto which the toner image is to be transferred, and a printing unit that prints the toner image onto the transfer medium, includes: detecting a print command for each image including information on printing mode including single-sided printing and double-sided printing; acquiring, upon detection of a print command for an image, image data of the image to output the image data to the image forming unit; controlling the conveyor unit to feed a transfer medium from a feed tray to the printing unit in response to a first print command for printing a first side by double-sided printing, and to feed the transfer medium to the printing unit from a conveying path, where the transfer medium is temporarily kept after the first side is printed, in response to a second print command for printing a second side by double-sided printing; and controlling the conveyor unit to convey the transfer medium to the conveying path after the first side is printed, and to eject the transfer medium after the second side is printed. The conveyor unit does not feed a transfer medium from the feed tray to the printing unit when the second print command is not detected within a predetermined time after detection of the first print command.

According to still another aspect of the present invention, a computer-readable recording medium stores therein a computer program that causes a computer to implement the above method.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
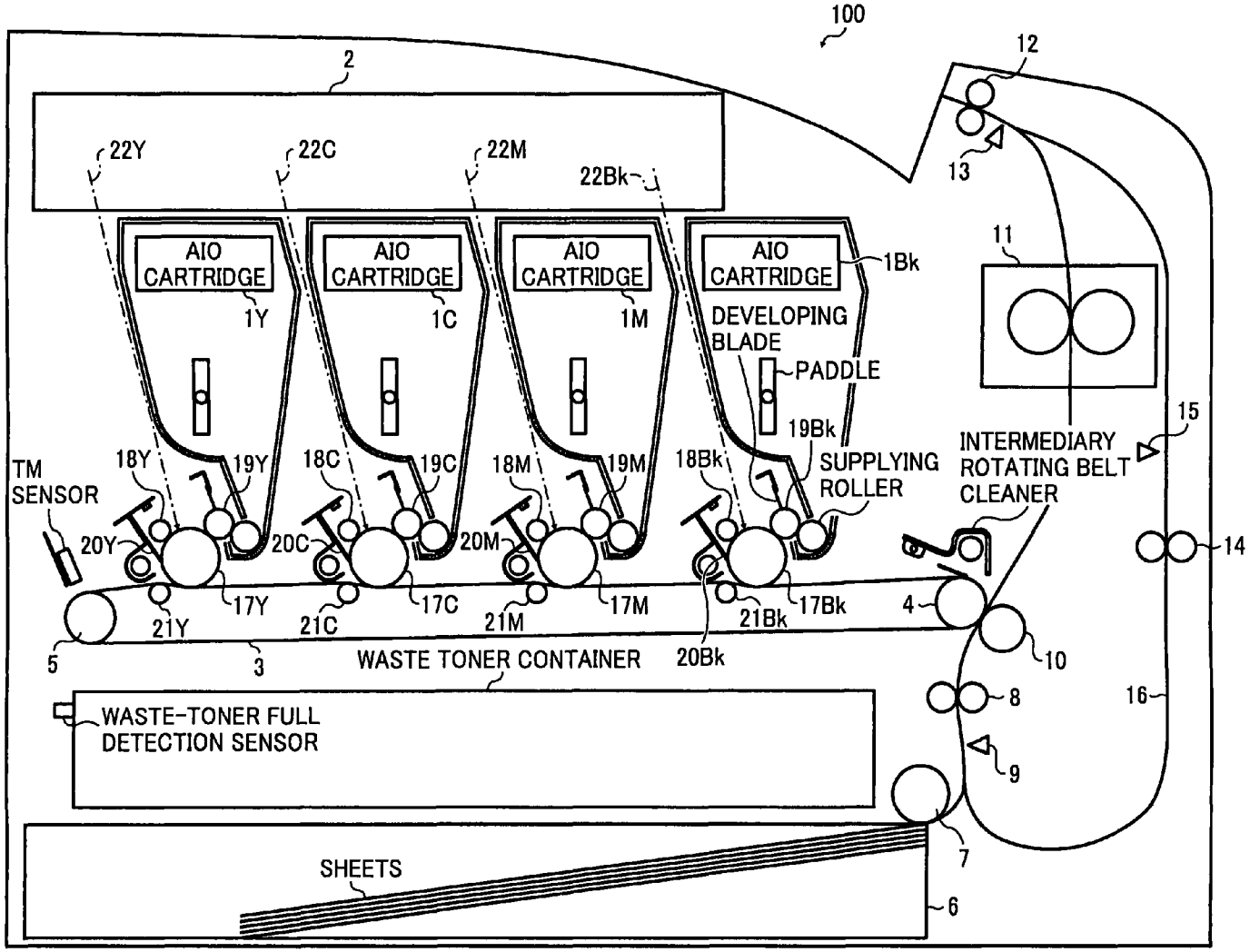
FIG. 1 is a schematic diagram of an image forming apparatus according to a first embodiment of the present invention.

FIG. 1 is a schematic diagram of an image forming apparatus 100 according to a first embodiment of the present invention. The image forming apparatus 100 is explained below as, for example, a tandem full-color image forming apparatus. The image forming apparatus 100 includes a image forming unit that forms a toner image, a conveyor unit that conveys a recording sheet in the image forming apparatus, and a printing unit that transfers and fixes the toner image onto the recording sheet (i.e., prints the toner image on a sheet).

The image forming unit includes all-in-one (AIO) cartridges (electrophotographic processing units) 1Bk (black), 1M (magenta), 1C (cyan), and 1Y (yellow), an exposing unit 2, a transfer belt 3, a driving roller 4, and a transfer-belt tension roller 5. The AIO cartridges 1Bk, 1M, 1C, and 1Y are arranged sequentially along the transfer belt 3. The transfer belt 3 is rotated counterclockwise, and the AIO cartridges 1Bk, 1M, 1C, and 1Y are arranged in sequence from the upstream toward downstream of the rotation.

The conveyor unit of the image forming apparatus 100 includes a main tray 6, a feed roller 7, registration rollers 8, a registration sensor 9, a secondary transfer roller 10, a fixing unit 11, eject rollers 12, an eject sensor 13, double-sided printing rollers 14, a double-sided printing sensor 15, and a conveying path 16 for double-sided printing.

The driving roller 4, the secondary transfer roller 10, and the fixing unit 11 also function as the printing unit.

The AIO cartridges 1Bk, 1M, 1C, and 1Y function to transfer black, magenta, cyan, and yellow images, respectively, onto the transfer belt 3. These AIO cartridges 1Bk, 1M, 1C, and 1Y forms images in different colors, but have the same internal structures.

The AIO cartridge 1Bk includes a photosensitive element 17Bk, a charging unit 18Bk, a developing unit 19Bk, and a cleaning blade 20Bk surrounding the photosensitive element 17Bk, and a primary transfer belt 21Bk. The AIO cartridge 1M includes a photosensitive element 17M, a charging unit 18M, a developing unit 19M, and a cleaning blade 20M surrounding the photosensitive element 17M and a primary transfer belt 21M. The AIO cartridge 1C includes a photosensitive element 17C, a charging unit 18C, a developing unit 19C, and a cleaning blade 20C surrounding the photosensitive element 17C and a primary transfer belt 21C. The AIO cartridge 1Y includes a photosensitive element 17Y, a charging unit 18Y, a developing unit 19Y, and a cleaning blade 20Y surrounding the photosensitive element 17Y and a primary transfer belt 21Y.

The exposing unit 2 irradiates the AIO cartridge 1Bk, 1M, 1C, and 1Y with laser beams 22Bk, 22M, 22C, and 22Y each corresponding to the color of an image formed by each of the AIO cartridge 1Bk, 1M, 1C and 1Y.

The transfer belt 3 conveys the toner image transferred thereto toward the driving roller 4. The transfer belt 3 is an endless belt, and rotated around the driving roller 4 and the transfer-belt tension roller 5.

The driving roller 4 is rotated by a driving motor 50 (not shown, described in detail later). The rotation of the driving roller 4 is transmitted to the transfer-belt tension roller 5 via the transfer belt 3 to make the transfer-belt tension roller 5 rotate. In this manner, the transfer belt 3 is rotated around the driving roller 4 and the transfer-belt tension roller 5. The driving motor 50, the driving roller 4, and the transfer-belt tension roller 5 function as driving means to rotate the transfer belt 3.

The main tray 6 holds recording sheets. The feed roller 7 is rotated by the driving motor 50, and conveys a recording sheet from the main tray 6 to the registration rollers 8. The registration rollers 8 are also rotated by the driving motor 50, and convey the recording sheet fed by the feed roller 7 to the driving roller 4 and the secondary transfer roller 10. The registration sensor 9 is positioned near the registration rollers 8 and detects the presence of any recording sheet. The secondary transfer roller 10 is in contact with the driving roller 4 and is driven in rotation together with the driving roller 4. The driving roller 4 and the secondary transfer roller 10 transfer (print) the toner images formed on the transfer belt 3, which is carried by the driving roller 4, onto the recording sheet conveyed by the registration rollers 8.

Rollers in the fixing unit 11 convey the recording sheet to a fixer in the fixing unit 11, so that the toner image transferred onto the recording sheet is fixed with heat and pressure applied thereto. The eject rollers 12 are rotated by the driving motor 50 to eject the recording sheet from the image forming apparatus, or to convey the recording sheet to the double-sided printing rollers 14. The eject sensor 13 is positioned near the eject rollers 12, and detects the presence of any recording sheet. The double-sided printing rollers 14 are rotated by the driving motor 50, and convey the recording sheet to the conveying path 16, or from the conveying path 16 to the registration rollers 8. The double-sided printing sensor 15 is positioned near the double-sided printing rollers 14, and detects the presence of any recording sheet. The conveying path 16 temporarily holds the recording sheet whose one side is printed until printing of the second side begins.

A black toner image is formed by the AIO cartridge 1Bk and transferred onto the transfer belt 3. Upon forming a black image, the outer surface of the photosensitive element 17Bk is charged uniformly by the charging unit 18Bk in the darkness. Subsequently, the photosensitive element 17Bk is exposed using the laser beam 22Bk, which corresponds to the black image irradiated from the exposing unit 2, to create an electrostatic latent image on the outer surface of the photosensitive element 17Bk. The developing unit 19Bk then visualizes the electrostatic latent image on the photosensitive element 17Bk using the black toner. In this manner, the black toner image is formed on the photosensitive element 17Bk.

The toner image is transferred onto the transfer belt 3 by the primary transfer belt 21Bk, at the point where the photosensitive element 17Bk meets with the transfer belt 3 (primary transferring position). By way of this transfer, the image is formed on the transfer belt 3 with the black toner. When the transfer of the toner image is completed, unnecessary residual toner on the outer surface of the photosensitive element 17Bk is removed with the cleaning blade 20Bk, and the photosensitive element 17Bk is kept in wait until a next image formation begins.

The portion of the transfer belt 3 that is transferred with the toner image by the AIO cartridge 1Bk is conveyed to the AIO cartridge 1M. The AIO cartridge 1M transfers the magenta toner image on the photosensitive element 17M using the same image forming process performed by the AIO cartridge 1Bk. In this process, the magenta toner image is superimposed over the black image formed on the transfer belt 3. The portion of the transfer belt 3 transferred with the image is then conveyed to the AIO cartridge 1C and the AIO cartridge 1Y. The cyan and yellow toner images, transferred on the photosensitive element 17C and the photosensitive element 17Y, respectively, are superimposed over the portion of the transfer belt 3 where the image is transferred, using the same process. In this manner, a full-colored toner image is formed on the transfer belt 3. The transfer portion formed with the superimposed images is conveyed to the driving roller 4 and the secondary transfer roller 10.

To print a black image only, the primary transfer belts 21M, 21C, and 21Y are evacuated away from the photosensitive elements 17M, 17C, and 17Y upon forming an image, and the toner image forming process is performed only for the black color.

Approximately in parallel with transferring the toner image to the transfer belt 3, recording sheets in the main tray 6 is conveyed, sequentially from the one on the top, to the registration rollers 8, by rotation of the feed roller 7 in the counterclockwise direction. The recording sheet is then kept in wait at the registration rollers 8. The registration sensor 9 detects the delivery of the recording sheet to the registration rollers 8.

By rotating the registration rollers 8, the recording sheet is conveyed to meet the toner image on the transfer belt 3 at the driving roller 4 and the secondary transfer roller 10. At this position, the toner image on the transfer belt 3 is transferred onto the recording sheet with the pressure applied by the driving roller 4 and the secondary transfer roller 10. The driving roller 4 functions both as the image forming unit by rotating the transfer belt 3, and as the printing unit by transferring the toner image onto the recording sheet. The secondary transfer roller 10 functions both as a conveyor unit by conveying the recording sheet, and as the printing unit by transferring the toner image onto the recording sheet.

The recording sheet transferred with the toner image is conveyed to the fixing unit 11. The recording sheet is conveyed to the fixing unit 11 by rotating the rollers in the fixing unit 11 alone, or with additional rotating force applied by the rollers (not shown). The toner image is fixed to the recording sheet by heat and pressure applied by the fixing unit 11. Therefore, the fixing unit 11 functions both as the conveyor unit by conveying the recording sheet, and as the printing unit by fixing the toner image onto the recording sheet.

If only one side of a sheet needs to be printed, the recording sheet fixed with the image is ejected from the image forming apparatus by rotating the eject rollers 12.

If both sides of a sheet need to be printed, the recording sheet fixed with the image is conveyed toward the eject sensor 13 by rotation of the eject rollers 12. When the eject sensor 13 detects the recording sheet, the eject rollers 12 are triggered to rotate in the opposite direction, and the recording sheet is conveyed in the direction toward the conveying path 16. When the double-sided printing sensor 15 detects the recording sheet, the double-sided printing rollers 14 are driven in rotation to convey the recording sheet to the conveying path 16. The recording sheet is then temporarily kept in the conveying path 16. This process allows the unprinted side of the recording sheet to face to the surface of the transfer belt 3 to be formed with the toner image.

To print the unprinted side of the recording sheet temporarily kept in the conveying path 16, the double-sided printing rollers 14 is rotated to convey the recording sheet to the registration rollers 8 again. Then, the registration rollers 8 are driven in rotation, conveying the recording sheet to the driving roller 4 and the secondary transfer roller 10. At this position, the toner image formed on the transfer belt 3 is printed onto the unprinted side of the recording sheet with pressure applied between the driving roller 4 and the secondary transfer roller 10.

The recording sheet transferred with the toner image is then conveyed to the fixing unit 11, and the toner image is fixed to the recording sheet by the heat and pressure applied by the fixing unit 11. Subsequently, the recording sheet having the fixed image on both sides thereof is directly ejected from the image forming apparatus by rotation of the eject rollers 12.

Printing Control

Figure 2:
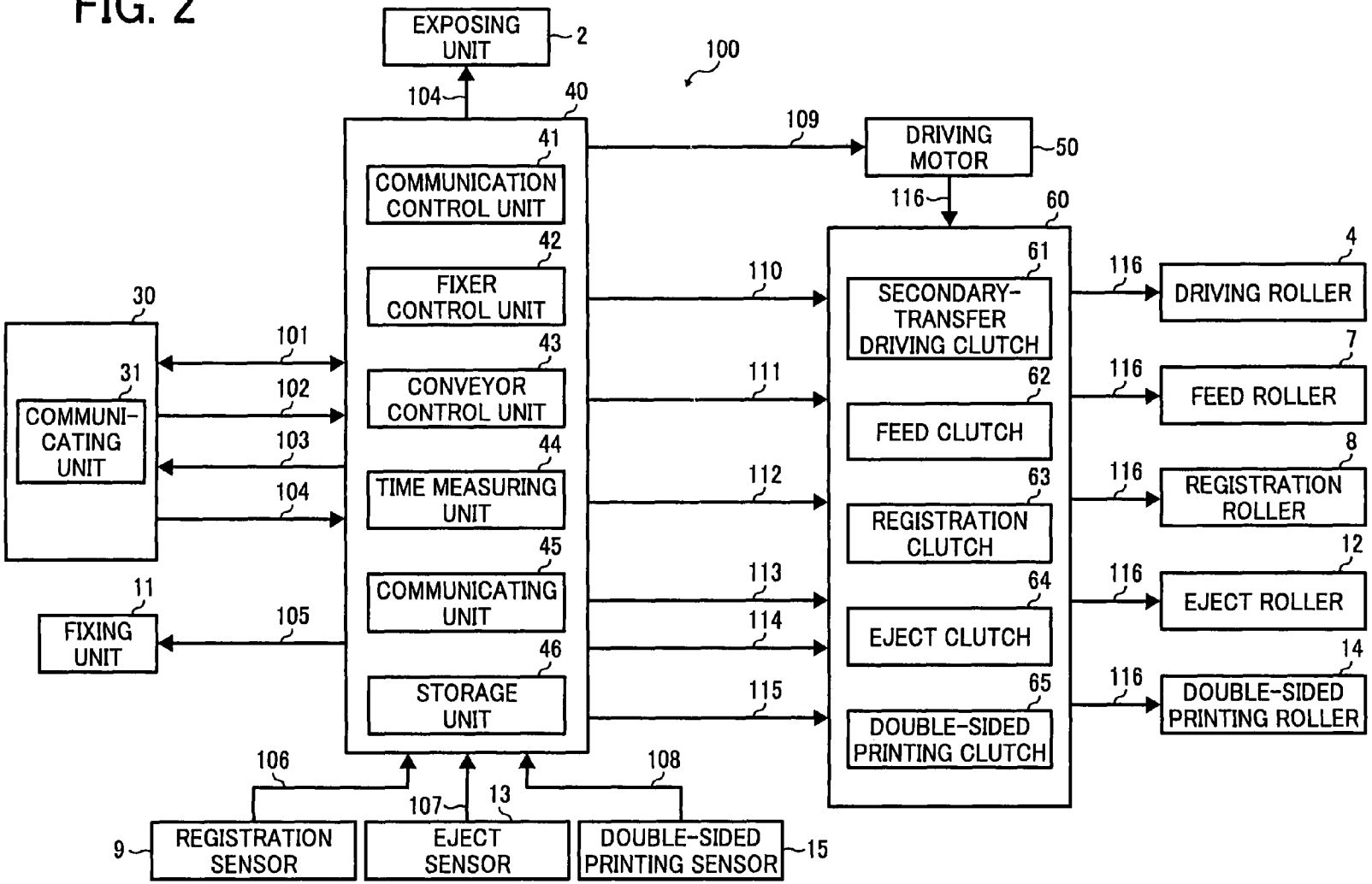
FIG. 2 is a functional block diagram of the image forming apparatus.

FIG. 2 is a functional block diagram of the image forming apparatus 100. The image forming apparatus 100 further includes a controller 30, a print control unit 40, the driving motor 50, and a driving-force communicating unit 60.

The controller 30 controls the image forming process, and sends a command to print the recording sheet, or sends image data to be printed to the print control unit 40. The controller 30 includes a communicating unit 31.

The communicating unit 31 communicates with the print control unit 40, and transmits image data to the print control unit 40. More specifically, the communicating unit 31 transmits and receives communicating signals 101, including printing information, such as a place to feed or eject a sheet or a type of printing, and error information that notifies an occurrence of an error in the image forming apparatus 100. The communicating unit 31 also transmits a print-request signal 102 to request a printing service, receives an image-request signal 103 requesting image data corresponding to a single printed image, and transmits image data 104 corresponding to the single printed image.

The print control unit 40 controls the driving roller 4 in the image forming unit, the conveyor unit to perform printing of an image as well as transmission and reception of image data to be printed.

The print control unit 40 includes a communication control unit 41, a fixer control unit 42, a conveyor control unit 43, a time measuring unit 44, a communicating unit 45, and a storage unit 46.

The communication control unit 41 controls reception of the image data 104 from the controller 30 by transmitting the image-request signal 103 to the controller 30. The communication control unit 41 also controls transmission of the image data 104 received from the controller 30 to the exposing unit 2 upon receiving the print-request signal 102 from the controller 30. The exposing unit 2 generates the laser beams 22Bk, 22M, 22C, and 22Y that are the exposure light rays, based on the image data 104 received from the communication control unit 41.

The fixer control unit 42 controls to start and stop the fixing unit 11. Specifically, the fixer control unit 42 controls transmission of a fixer control signal 105. The fixer control signal 105 is a signal providing an instruction to start or stop the fixing unit 11.

The conveyor control unit 43 controls to turn on and off the driving roller 4, the feed roller 7, the registration rollers 8, the eject rollers 12, and the double-sided printing rollers 14, based on the communicating signals 101, the print-request signal 102, and the image data 104 received from the controller 30, and a registration sensor signal 106, an eject-sensor signal 107, and a double-sided sensor signal 108.

Specifically, the conveyor control unit 43 controls transmission of a motor control signal 109 to the driving motor 50. The conveyor control unit 43 also controls transmission of a secondary-transfer driving clutch control signal 110, a feed-clutch control signal 111, a registration-clutch control signal 112, an eject-clutch control signal 113, a reversed solenoid signal 114, and a double-sided printing clutch control signal 115 to the driving-force communicating unit 60.

The registration sensor signal 106 is transmitted to the print control unit 40 when the registration sensor 9 detects or stops detecting a recording sheet. The eject-sensor signal 107 is transmitted to the print control unit 40 when the eject sensor 13 detects or stops detecting a recording sheet. The double-sided sensor signal 108 is transmitted to the print control unit 40 when the double-sided printing sensor 15 detects or stops detecting a recording sheet.

The motor control signal 109 instructs the driving motor 50 to turn on or off. The secondary-transfer driving clutch control signal 110 instructs a secondary-transfer driving clutch 61 (described later) in the driving-force communicating unit 60 to turn on or off. The feed-clutch control signal 111 instructs a feed clutch 62 (described later) in the driving-force communicating unit 60 to turn on or off. The registration-clutch control signal 112 instructs a registration clutch 63 (described later) in the driving-force communicating unit 60 to turn on or off. The eject-clutch control signal 113 and the reversed solenoid signal 114 instruct an eject clutch 64 (described later) in the driving-force communicating unit 60 to turn on or off. The double-sided printing clutch control signal 115 instructs a double-sided printing clutch 65 (described later) in the driving-force communicating unit 60 to turn on or off. These signals instruct on when being transmitted, and off when not being transmitted.

The time measuring unit 44 measures printing intervals T10 and T11, a feed wait time T2, and a print startup time, all of which are described in detail later.

The communicating unit 45 transmits and receives signals and image data. More specifically, the communicating unit 45 exchanges the communicating signals 101 with the controller 30. The communicating unit 45 also receives the print-request signal 102 from the controller 30, transmits the image-request signal 103 to the controller 30, and receives the image data 104 from the controller 30. The communicating unit 45 also transmits the image data 104 to the exposing unit 2, and transmits the fixer control signal 105 to the fixing unit 11. The communicating unit 45 receives the registration sensor signal 106 from the registration sensor 9, the eject-sensor signal 107 from the eject sensor 13, and the double-sided sensor signal 108 from the double-sided printing sensor 15. Furthermore, the communicating unit 45 transmits the motor control signal 109 to the driving motor 50, and transmits the secondary-transfer driving clutch control signal 110, the feed-clutch control signal 111, the registration-clutch control signal 112, the eject-clutch control signal 113, the reversed solenoid signal 114, and the double-sided printing clutch control signal 115 to the driving-force communicating unit 60.

The storage unit 46 stores therein information (e.g., image data) received by the communicating unit 45, and a computer program used by the print control unit 40.

The driving motor 50 turns on or off under the control of the motor control signal 109 transmitted by the conveyor control unit 43, and generates or stop generating a driving force 116 that rotates the driving roller 4, the feed roller 7, the registration rollers 8, the eject rollers 12, and the double-sided printing rollers 14. The driving force generated by the driving motor 50 is transmitted to the driving-force communicating unit 60. Precisely speaking, the driving motor 50 is a component included in the image forming unit, the conveyor unit, and the printing unit.

The driving-force communicating unit 60 communicates or decouples the driving force 116 of the driving motor 50 to or from each of the roller based on each of the signals received from the conveyor control unit 43. The driving-force communicating unit 60 includes the secondary-transfer driving clutch 61, the feed clutch 62, the registration clutch 63, the eject clutch 64, and the double-sided printing clutch 65. Precisely speaking, the driving-force communicating unit 60 is a component included in the image forming unit, the conveyor unit, and the printing unit.

The secondary-transfer driving clutch 61 communicates or decouples the driving force 116 of the driving motor 50 to or from the driving roller 4 based on the secondary-transfer driving clutch control signal 110 received from the conveyor control unit 43. The driving force 116 is transmitted to the driving roller 4 if the secondary-transfer driving clutch 61 is on. The driving force 116 is decoupled from the driving roller 4 if the secondary-transfer driving clutch 61 is off.

The feed clutch 62 communicates or decouples the driving force 116 of the driving motor 50 to or from the feed roller 7 based on the feed-clutch control signal 111 received from the conveyor control unit 43. The driving force 116 is transmitted to the feed roller 7 if the feed clutch 62 is on. The driving force 116 is decoupled from the feed roller 7 if the feed clutch 62 is off.

The registration clutch 63 communicates or decouples the driving force 116 of the driving motor 50 to or from the registration rollers 8 based on the registration-clutch control signal 112 received from the conveyor control unit 43. The driving force 116 is transmitted to the registration rollers 8 if the registration clutch 63 is on. The driving force 116 is decoupled from the registration rollers 8 if the registration clutch 63 is off.

The eject clutch 64 communicates or decouples the driving force 116 of the driving motor 50 to or from the eject rollers 12 based on the eject-clutch control signal 113 or the reversed solenoid signal 114 received from the conveyor control unit 43. The driving force 116 is transmitted to the eject rollers 12 if the eject clutch 64 is on. The driving force 116 is decoupled from the eject rollers 12 if the eject clutch 64 is off. The eject-clutch control signal 113 instructs the eject clutch 64 to communicate the driving force 116 to the eject rollers 12 so that the eject rollers 12 are rotated in the direction to eject the recording sheet from the image forming apparatus. The reversed solenoid signal 114 instructs the eject clutch 64 to communicate the driving force 116 to the eject rollers 12 so that the eject rollers 12 are rotated in the direction to send the recording sheet to the conveying path 16.

The double-sided printing clutch 65 communicates or decouples the driving force 116 of the driving motor 50 to or from the double-sided printing rollers 14 based on the double-sided printing clutch control signal 115 received from the conveyor control unit 43. The driving force 116 is transmitted to the double-sided printing rollers 14 if the double-sided printing clutch 65 is on. The driving force 116 is decoupled from the double-sided printing rollers 14 if the double-sided printing clutch 65 is off.

Figure 3:
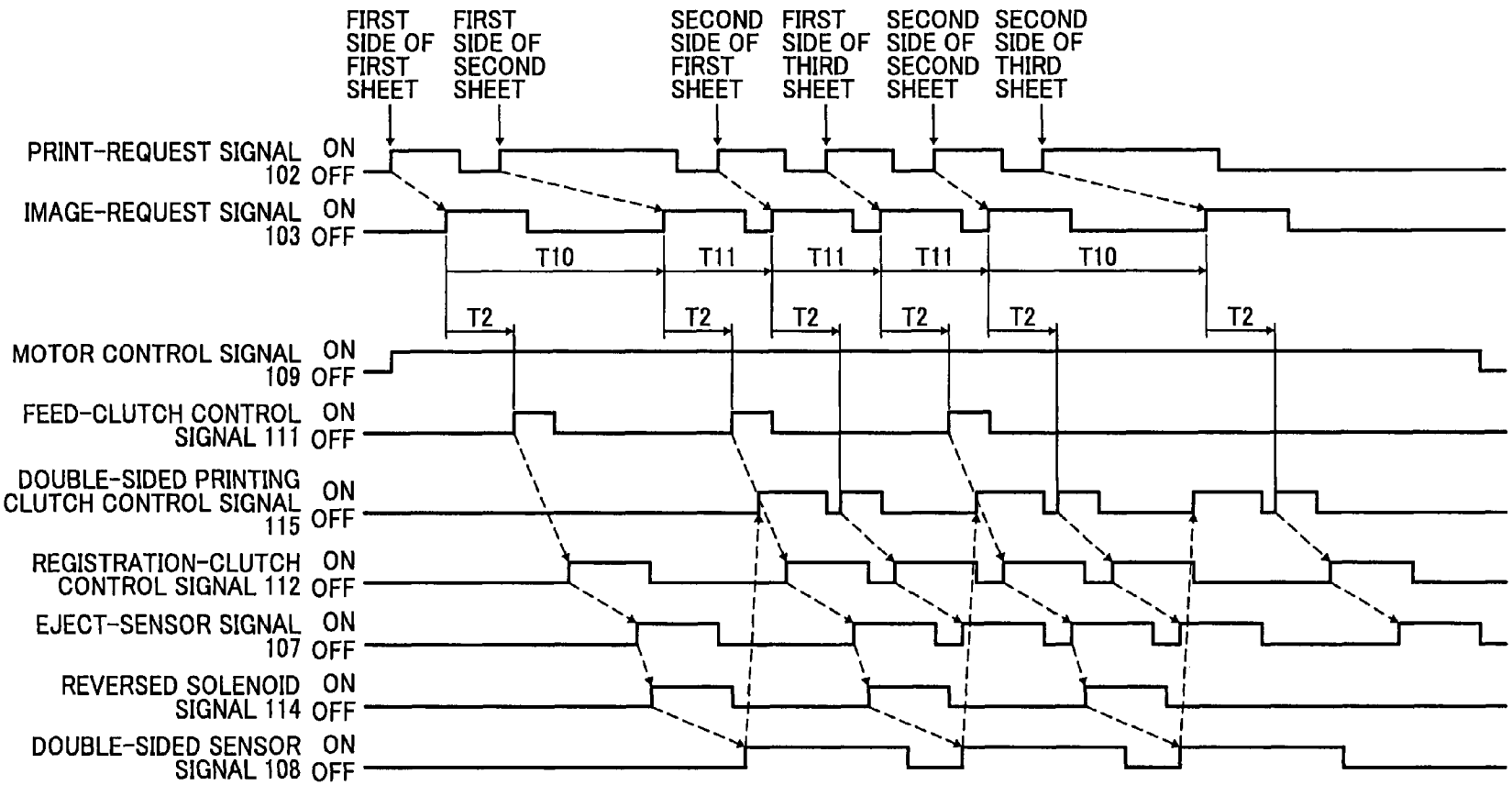
FIG. 3 is a timing chart of double-sided interleaf printing with the image forming apparatus in a normal condition.

FIG. 3 is a timing chart of double-sided interleaf printing (for printing three sheets) in a normal condition. Upon receiving (turning on) the print-request signal 102 for the first side of the first sheet from the controller 30, the print control unit 40 starts preparing for printing by setting the motor control signal 109 to on. The communicating signals 101 are sent from the controller 30 to the print control unit 40 in advance. Upon completing preparing for printing, the print control unit 40 sets the image-request signal 103 to on to request the image data 104 corresponding to the first side of the first sheet from the controller 30. At the same time, the print control unit 40 starts measuring the printing interval T10 and the feed wait time T2.

The printing intervals T10 is an interval between the time to begin printing the first side of the first sheet (to turn on the image-request signal 103) and the time to begin printing the first side of the second sheet, or the interval between the time to begin printing the second side of the (last −1)th sheet and the time to begin printing the second side of the last sheet. The printing interval T11 is an interval between the time to begin printing a sheet and the time to begin printing the subsequent sheet. The printing intervals T10 and T11 are predefined for each type of the image forming apparatus. Because of the nature of the interleaf printing, it takes time for the first sheet to be delivered to the conveying path 16 after printing the first side thereof, and also for the last sheet to be delivered to the conveying path 16 after printing the first side thereof. Therefore, the printing interval T10 is set to twice of the printing interval T11.

The feed wait time T2 is a time period required from requesting the controller 30 to transmit the image data 104, to turn the feed-clutch control signal 111 on, and to start feeding the recording sheet. Upon elapse of the feed wait time T2, the print control unit 40 sets the feed-clutch control signal 111 to start feeding the first recording sheet held in the main tray 6. After starting feeding the sheet, the print control unit 40 conveys the recording sheet in the direction indicated by the dotted arrows in FIG. 3.

If the print control unit 40 receives the print-request signal 102 from the controller 30 for the first side of the second sheet before the feed wait time T2 has elapsed, the print control unit 40 turns on the image-request signal 103 and requests the image data 104 corresponding to the first side of the second sheet upon elapse of the printing interval T10. At the same time, the print control unit 40 starts measuring the printing interval T11 and the feed wait time T2. Upon elapse of the feed wait time T2, the print control unit 40 sets the feed-clutch control signal 111 to on to start feeding the second recording sheet in the main tray 6. After starting feeding the sheet, the print control unit 40 conveys the recording sheet in the direction indicated by the dotted arrows in FIG. 3.

If the print control unit 40 receives the print-request signal 102 from the controller 30 for the second side of the first sheet before the feed wait time T2 has elapsed, the print control unit 40 turns on the image-request signal 103 and requests the image data 104 corresponding to the second side of the first sheet upon elapse of the printing interval T11. At the same time, the print control unit 40 starts measuring the printing interval T11 and the feed wait time T2 again. Upon elapse of the feed wait time T2, the print control unit 40 sets the double-sided printing clutch control signal 115 to on to start feeding the first recording sheet temporarily kept in the conveying path 16. After starting feeding the sheet, the print control unit 40 conveys the recording sheet in the direction indicated by the dotted arrows in FIG. 3. Subsequently, the same process is repeated to perform the double-sided printing for each of the three sheets.

Figure 4A:
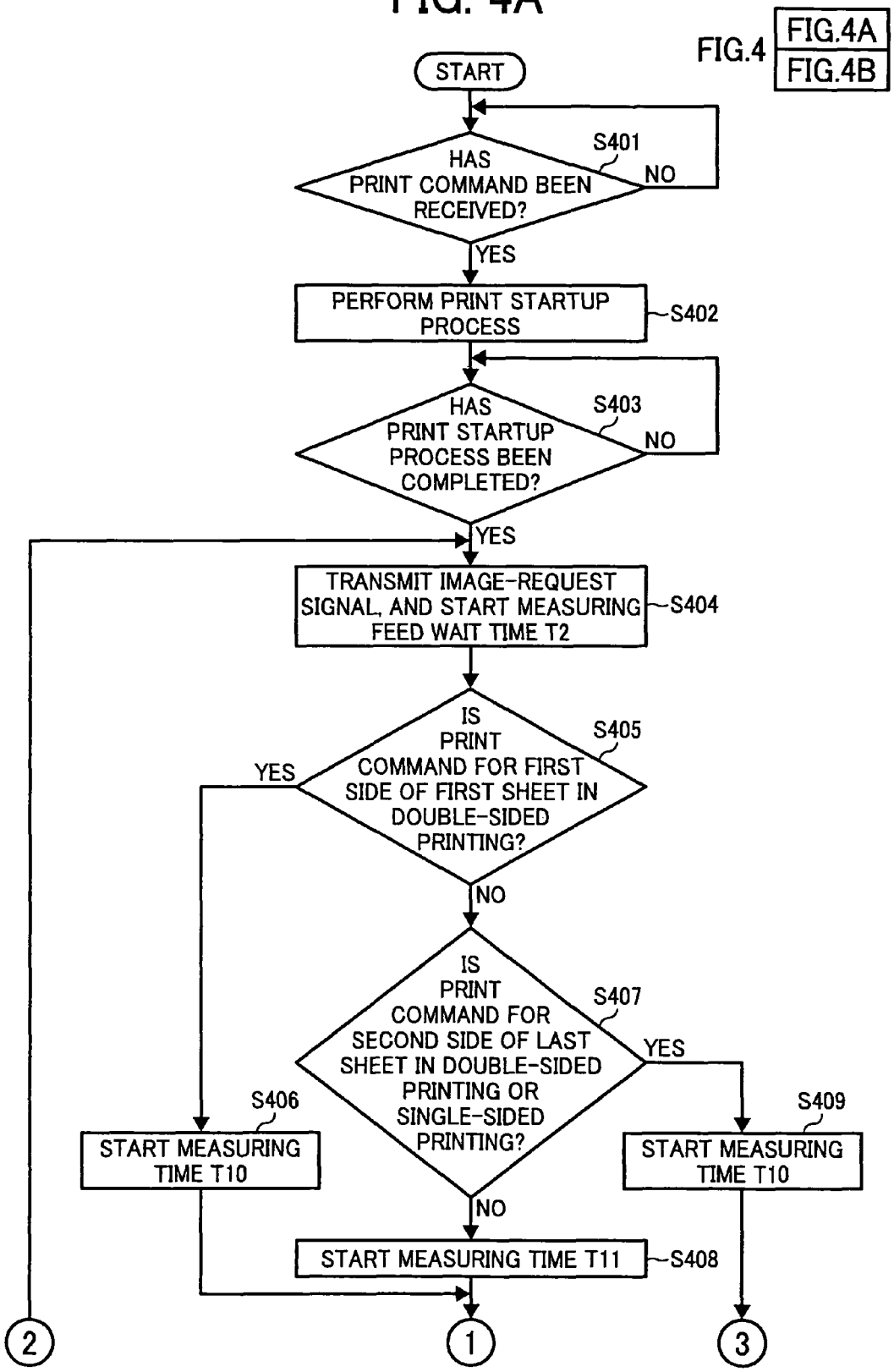
FIG. 4 is a flowchart of a printing process performed by the image forming apparatus.
Figure 4B:
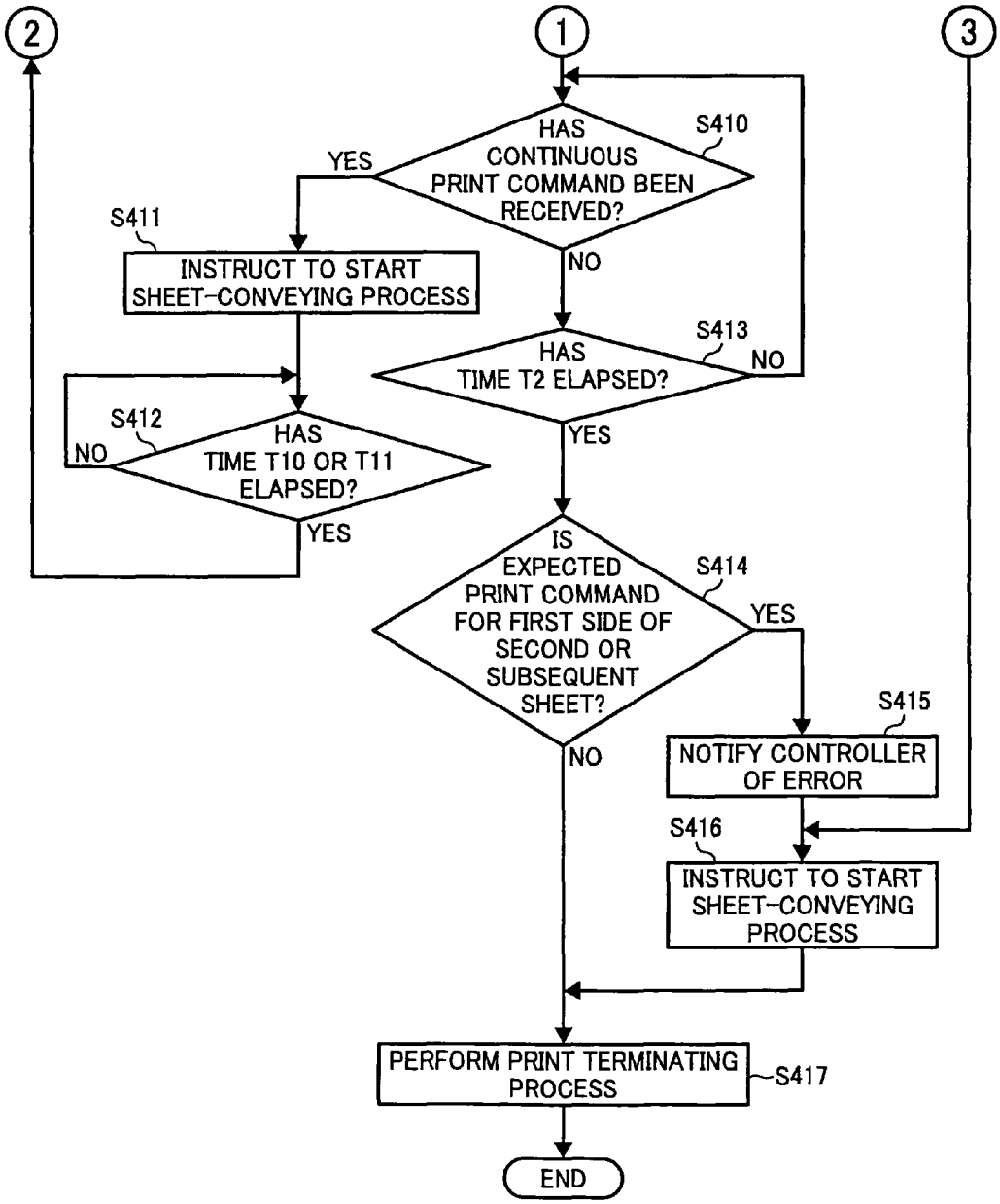

Described below is a printing process and a sheet-conveying process performed by the image forming apparatus 100. The printing process and the sheet-conveying process take place in close correlation with each other. FIG. 4 is a flowchart of the printing process.

The print control unit 40 determines whether a print command has been received from the controller 30 (step S401). More specifically, the print control unit 40 determines whether the communication control unit 41 has received the print-request signal 102 from the controller 30. It should be noted that step S401 is performed only when the image forming apparatus 100 in the idle state begins printing the first sheet.

If no print command has been received from the controller 30 (No at step S401), the print control unit 40 performs step S401 again after a predetermined time has elapsed. In this example, step S401 is repeated in every 2 milliseconds until a print command is received while the print control unit 40 is ON.

If a print command has been received from the controller 30 (Yes at step S401), the print control unit 40 performs a print startup process (step S402). More specifically, the fixer control unit 42 sends the fixer control signal 105 to the fixing unit 11, instructing the fixing unit 11 to start up, and the conveyor control unit 43 sends the motor control signal 109 to the driving motor 50, instructing the driving motor 50 to turn on.

Then, the print control unit 40 determines whether the print startup process has been completed (step S403). More specifically, the print startup process is determined to be completed if a predefined print startup time has elapsed. The print start up time is measured by the time measuring unit 44 upon starting step S402.

If the print startup process is completed (Yes at step S403), the communication control unit 41 transmits the image-request signal 103 to the controller 30. At the same time, the time measuring unit 44 starts measuring the feed wait time T2 (step S404). As a result, the print control unit 40 receives the image data 104 from the controller 30, and sends the image data 104 to the exposing unit 2. Based on the image data 104, the exposing unit 2 generates the laser beams 22Bk, 22M, 22C, and 22Y as exposure light rays. Eventually, the toner image is formed on the transfer belt 3, and the toner image is transferred (printed) onto a recording sheet at a transferring (printing) step (step S507) of the sheet-conveying process shown in FIG. 5. If the print startup process is not completed (No at step S403), step S403 is performed again after a predetermined time has elapsed.

The print control unit 40 determines whether the print command from the controller 30 is for the first side of the first sheet of double-sided printing (step S405). More specifically, it is determined based on the communicating signals 101 or the print-request signal 102 received from the controller 30.

If the print command from the controller 30 is for the first side of the first sheet (Yes at step S405), the time measuring unit 44 sets the printing interval to T10, and starts measuring the time (step S406). Subsequently, the system control proceeds to step S410.

If the print command from the controller 30 is not for the first side of the first sheet (No at step S405), the print control unit 40 further determines whether the print command is for the second side of the last sheet or for single-sided printing (step S407).

If the print command is neither for the second side of the last sheet nor for single-sided printing (No at step S407), the time measuring unit 44 sets the printing interval to T11, and starts measuring the time (step S408). Subsequently, the system control proceeds to step S410.

If the print command is for the second side of the last sheet in the double-sided printing or for single-sided printing (Yes at step S407), the time measuring unit 44 sets the printing interval to T10, and starts measuring the time (step S409). Subsequently, the system control proceeds to step S416 to start the sheet-conveying process. If the printing is to be performed continuously, the sheet-conveying process is performed in parallel with the printing process. In other words, while the printing process is being performed for the nth sheet, the sheet-conveying process (described in detail later) for the (n−1)th sheet, or (n−2)th sheet in some situations, are performed in parallel. After issuance of a command to start the sheet-conveying process, the system control proceeds to step S417.

At step S410, the print control unit 40 determines whether a next print command (continuous print command) has been received from the controller 30 (step S410). More specifically, it is determined if the communication control unit 41 has received the print-request signal 102 from the controller 30 again.

If a next print command (continuous print command) has been received from the controller 30 (Yes at step S410), the print control unit 40 instructs to start the sheet-conveying process at the subsequent step S411. After issuing the instruction to start the sheet-conveying process, the print control unit 40 determines whether the printing time interval T10 or T11, which is measured by the time measuring unit 44, has elapsed (step S412).

If the printing time interval T10 or T11 has elapsed (Yes at step S412), the system control returns to step S404 and repeats the subsequent steps. If the printing time interval T10 or T11 has not elapsed yet (No at step S412), the system control performs step S412 again after a predetermined time has elapsed.

If the continuous print command has not been received from the controller 30 (No at step S410), the print control unit 40 further determines whether the feed wait time T2, which is measured by the time measuring unit 44, has elapsed (step S413). If the feed wait time T2 has not elapsed yet (No at step S413), step S410 is performed again after a predetermined time has elapsed.

If the feed wait time T2 has elapsed (Yes at step S413), it is interpreted, as the print-request signal 102 not being sent from the controller 30 within a specified time, some kind of error has occurred. Therefore, a process takes place to prevent the error from causing a jam. The print control unit 40 further determines whether the expected continuous print command, which is supposed to have been received, is for the first side of the second or a subsequent sheet in double-sided printing (step S414).

If the expected continuous print command is for the first side of the second or a subsequent sheet in double-sided printing (Yes at step S414), the recording sheet printed on its first side is temporarily kept in the conveying path 16. Therefore, the print control unit 40 determines that an error has occurred and notifies the controller 30 of the error (step S415).

The error is notified by the facts that the print-request signal 102 has not been received from the controller 30 within the feed wait time T2, and that the recording sheet is temporarily kept in the conveying path 16. Upon receiving the notification of the error, the controller 30 provides a notification on a display, such as a control panel (not shown), for a user that the error has occurred and the recording sheet is still in the conveying path 16. At the same time, the conveyor control unit 43 determines that the error has occurred, and the sheet-conveying process is terminated at step S501 described later. By the notification, the user can remove the recording sheet from the conveying path 16. As a result, a jam can be prevented from occurring in another subsequent printing process. After removing the recording sheet, the user can provide a print instruction to start printing from the point where the printing error has occurred.

At step S416, the print control unit 40 provides an instruction to start the sheet-conveying process. After providing the command, the system control proceeds to step S417.

If the expected continuous print command is not for the first side of the second or a subsequent sheet in double-sided printing (No at step S414), the recording sheet printed on its the second side has been ejected from the image forming apparatus. Therefore, no recording sheet remains in the conveying path 16, causing no paper jam. Subsequently, the system control proceeds to step S417.

At step S417, the print control unit 40 performs a print terminating process. More specifically, the fixer control unit 42 transmits the fixer control signal 105 to the fixing unit 11, instructing to stop the fixing unit 11. At the same time, the conveyor control unit 43 transmits the motor control signal 109 to the driving motor 50, instructing to turn off the driving motor 50. The printing interval T10 or T11 may have either elapsed or not elapsed before starting the print terminating process.

Figure 5A:
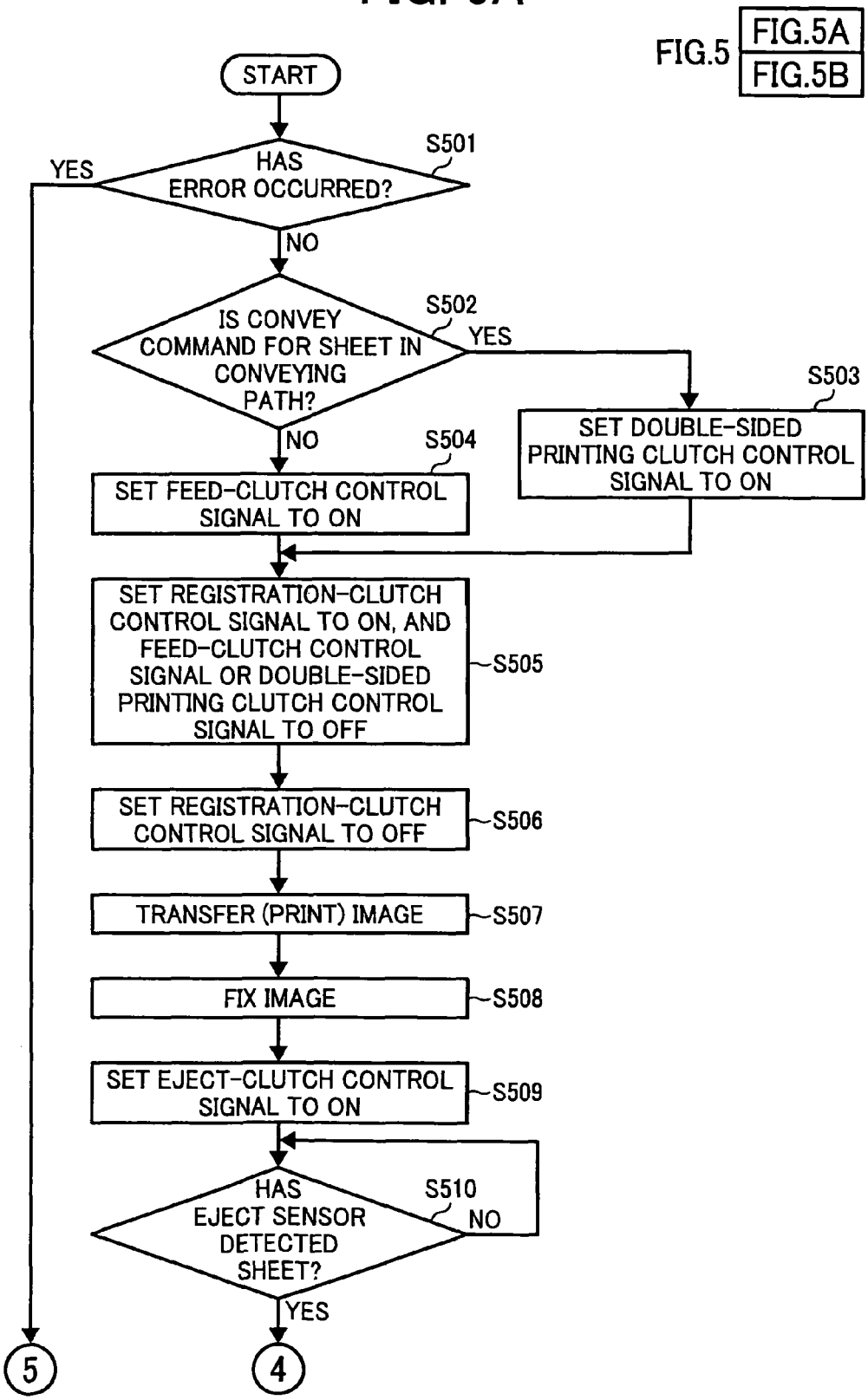
FIG. 5 is a flowchart of a sheet-conveying process performed by the image forming apparatus.
Figure 5B:
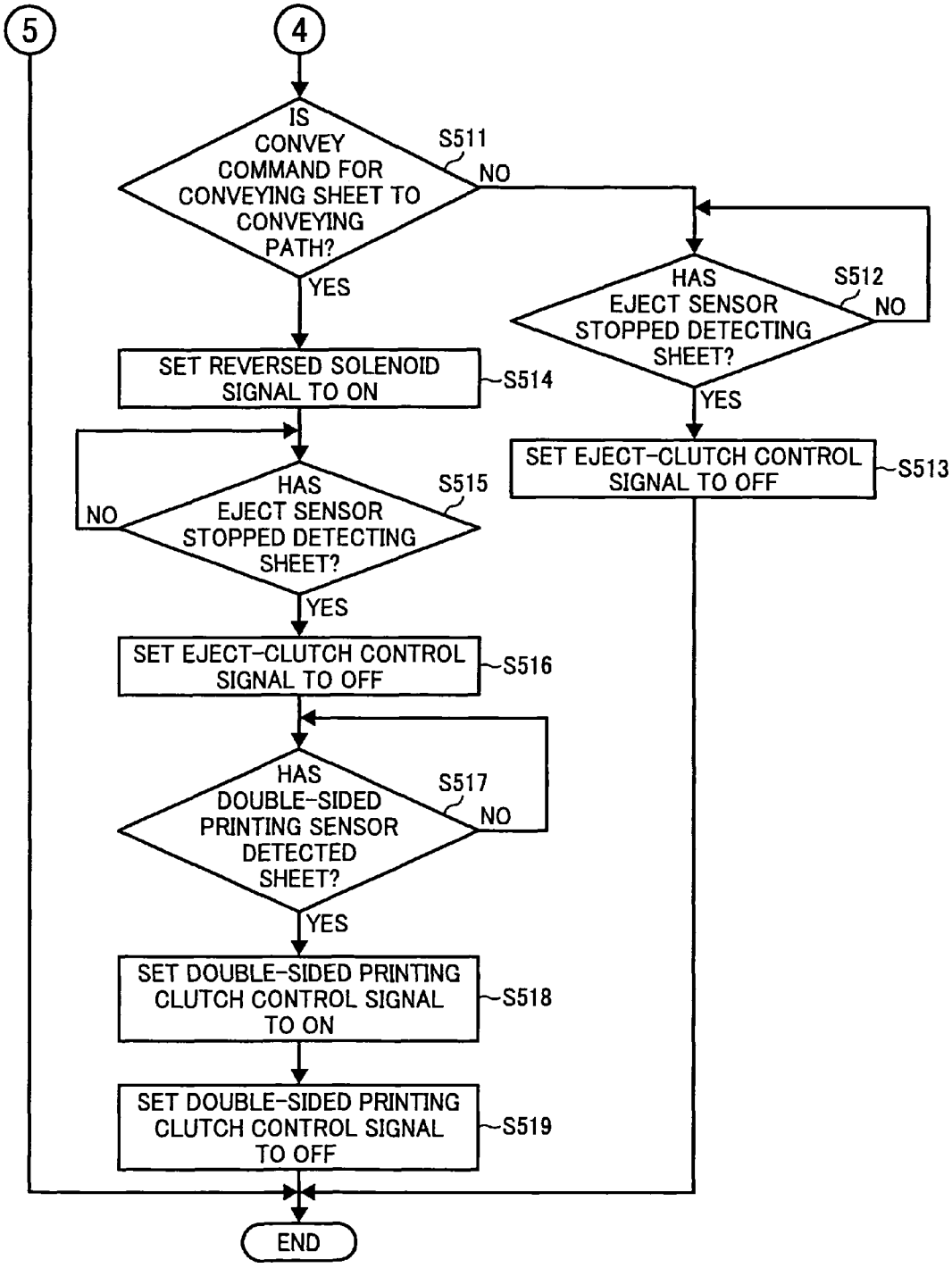

FIG. 5 is a flowchart of the sheet-conveying process. The conveyor control unit 43 determines whether an error has occurred (step S501). If an error has occurred (Yes at step S501), the conveyor control unit 43 terminates the sheet-conveying process. Because the sheet-conveying process is no longer continued, the recording sheet in the conveying path 16 is prevented from colliding with the one fed from the main tray 6. Therefore, a paper jam can be avoided.

If no error has occurred (No at step S501), the conveyor control unit 43 further determines whether a command is issued to print the second page in the double-sided printing (step S502). In other words, the conveyor control unit 43 further determines whether a command is issued to convey the recording sheet temporarily kept in the conveying path 16.

If a command is issued to convey the recording sheet temporarily kept in the conveying path 16 (Yes at step S502), the conveyor control unit 43 sets the double-sided printing clutch control signal 115 to on, and the double-sided printing clutch 65 is turned on (step S503). As a result, the driving force 116 of the driving motor 50 is transmitted to the double-sided printing rollers 14 to drive the double-sided printing rollers 14 in rotation, conveying the recording sheet to the registration rollers 8.

If a command is not issued for conveying the sheet temporarily kept in the conveying path 16, in other words, a command is issued to feed a sheet from the main tray 6 (No at step S502), the conveyor control unit 43 sets the feed-clutch control signal 111 to on, and instructs the feed clutch 62 to turn on (step S504). As a result, the driving force 116 of the driving motor 50 is transmitted to the feed roller 7, driving the feed roller 7 in rotation, conveying the recording sheet to the registration rollers 8. When the recording sheet reaches the registration rollers 8, the conveyor control unit 43 receives the registration sensor signal 106 indicating that the registration sensor 9 has detected a recording sheet. In this manner, the conveyor control unit 43 can recognize the exact position of the recording sheet.

While performing steps S501 to S504, the conveyor control unit 43 also sets the secondary-transfer driving clutch control signal 110 to on to instruct the secondary-transfer driving clutch 61 to turn on. As a result, the driving force 116 of the driving motor 50 is transmitted to the driving roller 4, driving the driving roller 4 in rotation. This process causes the transfer belt 3 to rotate counterclockwise around the driving roller 4 and the transfer-belt tension roller 5. In this manner, a toner image is transferred onto the transfer belt 3 by each of the AIO cartridges 1Bk, 1M, 1C, and 1Y.

Upon the recording sheet reaching the registration rollers 8, the conveyor control unit 43 sets the registration-clutch control signal 112 to on to instruct the registration clutch 63 to turn on, and sets the double-sided printing clutch control signal 115 or the feed-clutch control signal 111 to off to instruct the double-sided printing clutch 65 or the feed clutch 62 to turn off at the timing the toner image on the transfer belt 3 is conveyed to where the tip of the recording sheet is located (step S505).

As a result, the driving force 116 of the driving motor 50 is transmitted to the registration rollers 8 to drive the registration rollers 8 in rotation, conveying the recording sheet to the driving roller 4 and the secondary transfer roller 10. The driving force 116 of the driving motor 50 is decoupled from the double-sided printing rollers 14 or the feed roller 7, stopping rotation of the double-sided printing rollers 14 and the feed roller 7.

When the recording sheet is conveyed to the driving roller 4 and the secondary transfer roller 10, the conveyor control unit 43 sets the registration-clutch control signal 112 to off to instruct the registration clutch 63 to turn off (step S506). As a result, the driving force 116 of the driving motor 50 is decoupled from the registration rollers 8, and rotation of the registration rollers 8 is stopped.

Subsequently, the recording sheet is conveyed between the driving roller 4 and secondary transfer roller 10 with a pressure-applied thereto, and the toner image on the transfer belt 3 is transferred (printed) on the recording sheet (step S507).

To convey the recording sheet transferred with the toner image to the fixing unit 11, the conveyor control unit 43 provides a command to rotate either the rollers in the fixing unit 11 or other rollers (not shown), so that the rollers in the fixing unit 11 are rotated in turn. In the fixing unit 11, the toner image on the recording sheet is fixed by heat and pressure (step S508).

The conveyor control unit 43 sets the eject-clutch control signal 113 to on to instruct the eject clutch 64 to turn on (step S509). As a result, the driving force 116 of the driving motor 50 is transmitted to the eject rollers 12 to drive the eject rollers 12 in rotation, conveying the recording sheet near to the eject sensor 13.

The conveyor control unit 43 determines whether to have received the eject-sensor signal 107 notifying that the recording sheet has been detected from the eject sensor 13 (step S510). If the eject-sensor signal 107 has been received (Yes at step S510), the conveyor control unit 43 further determines whether the command is issued to convey the sheet to the conveying path 16 (step S511). If the eject-sensor signal 107 has not been received (No at step S510), step S510 is performed again after a predetermined time has elapsed.

If the command is not issued to convey the sheet to the conveying path 16, that is, the printing for the sheet has been completed (No at step S511), the eject rollers 12 keep rotating. The conveyor control unit 43 further determines whether to have received the eject-sensor signal 107 notifying that the recording sheet is no longer detected from the eject sensor 13 (step S512).

If the eject-sensor signal 107 is received from the eject sensor 13, that is, the recording sheet has been ejected from the image forming apparatus (Yes step S512), the conveyor control unit 43 sets the eject-clutch control signal 113 to off to instruct the eject clutch 64 to turn off (step S513). As a result, the driving force 116 of the driving motor 50 is decoupled from the eject rollers 12, stopping the eject rollers 12. The conveyor control unit 43 then terminates the sheet-conveying process. If the conveyor control unit 43 determines that the eject-sensor signal 107 has not been received (No at step S512), step S512 is performed again after a predetermined time has elapsed.

If the command is issued to convey the sheet to the conveying path 16, that is, the other side of the recording sheet needs to be printed (Yes at step S511), the conveyor control unit 43 sets the reversed solenoid signal 114 to on (step S514). As a result, the driving force 116 of the driving motor 50 is transmitted to the eject rollers 12 in the reverse direction, rotating the eject rollers 12 in the reverse direction, conveying the recording sheet toward the double-sided printing sensor 15. The conveying route with the double-sided printing sensor 15 and the conveying path 16 is separated from the route with the fixing unit 11 and the registration rollers 8. The conveying route is switched when the eject rollers 12 is rotated in the reverse direction to return the recording sheet.

The conveyor control unit 43 determines whether to have received the eject-sensor signal 107 notifying that the recording sheet is no longer detected from the eject sensor 13 (step S515). If the eject-sensor signal 107 has been received from the eject sensor 13, in other words, that the sheet has left near the eject sensor 13 and moved inside the image forming apparatus (Yes at step S515), the conveyor control unit 43 sets the eject-clutch control signal 113 to off (step S516). As a result, the driving force 116 of the driving motor 50 is decoupled from the eject rollers 12, and the eject rollers 12 are stopped. The recording sheet is conveyed toward the double-sided printing sensor 15 either before the eject rollers 12 are stopped, or conveyed by the conveyor control unit 43 instructing the rollers (not shown) to rotate. If the eject-sensor signal 107 has not been received (No at step S515), step S515 is performed again after a predetermined time has elapsed.

The conveyor control unit 43 determines whether to have received the double-sided sensor signal 108 notifying that the recording sheet is detected from the double-sided printing sensor 15 (step S517). If the double-sided sensor signal 108 has not been received, (No at step S517), step S517 is performed again after a predetermined time has elapsed.

If the double-sided sensor signal 108 has been received (Yes at step S517), the conveyor control unit 43 sets the double-sided printing clutch control signal 115 to on, and instructs the double-sided printing clutch 65 to turn on (step S518). As a result, the driving force 116 of the driving motor 50 is transmitted to the double-sided printing rollers 14 to drive the double-sided printing rollers 14 in rotation. In this manner, the recording sheet is conveyed to the conveying path 16. Upon determining that the recording sheet is delivered to the conveying path 16 based on a predetermined time having been elapsed, the conveyor control unit 43 sets the double-sided printing clutch control signal 115 to off, and instructs the double-sided printing clutch 65 to turn off (step S519). As a result, the driving force 116 of the driving motor 50 is decoupled from the double-sided printing rollers 14, and the double-sided printing rollers 14 stops rotating. The conveyor control unit 43 terminates the sheet-conveying process.

Figure 6:
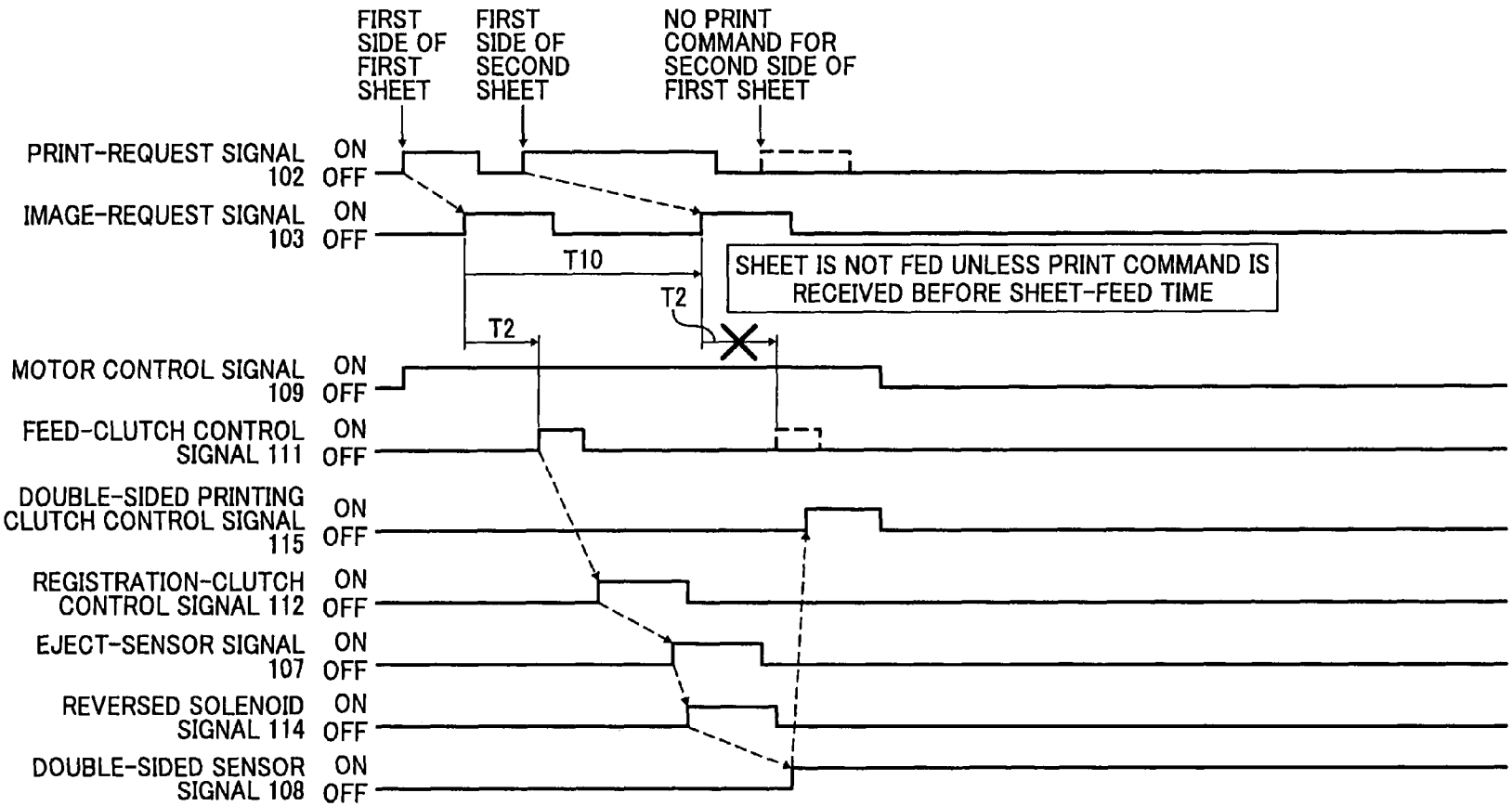
FIG. 6 is a timing chart of interleaf double-sided printing when no command to print the second side of the first sheet is issued from a controller shown in FIG. 2.

FIG. 6 is a timing chart of the interleaf double-sided printing when the print control unit 40 did not accept a print command for the second side of the first sheet from the controller 30 before the feed wait time T2 has elapsed. If the feed wait time T2 has elapsed before receiving a print command for the second side of the first sheet, the print control unit 40 determines that error has occurred and stops the sheet-conveying process for conveying the second sheet from the main tray 6, that is, stops the printing process of the first side of the second sheet. As a result, the first recording sheet in the conveying path 16 can be protected against being collided by the second sheet being conveyed thereto. In this manner, the paper jam can be avoided. Because the error is notified from the print control unit 40 to the controller 30, the controller 30 can recognize that the printing process of the first side of the second sheet has been aborted.

According to the first embodiment, the print control unit 40 does not give any command to the image forming unit, except to provide a control to the driving roller 4 and image data to the exposing unit 2. However, the print control unit 40 may also provide commands to other elements in the image forming unit. For example, the print control unit 40 can issue commands to start or stop each of the AIO cartridges 1Bk, 1M, 1C, and 1Y. In such an arrangement, each of the AIO cartridges 1Bk, 1M, 1C, and 1Y is started and stopped in the print startup process and the print terminating process performed by the print control unit 40.

The print control unit 40 determines whether the print startup process has been completed based on the elapse of the time required to complete the print startup process. However, the print control unit 40 can also determines the completion of the print startup process by receiving a notification from the fixing unit 11 or the driving motor 50, notifying their completion of the startup processes.

The print control unit 40 determines that an error has occurred and notifies thereof to the controller 30 under the conditions that the print control unit 40 has not received any print-request signal 102 from the controller 30 within a certain time period, and that the recording sheet with its first side printed is in the conveying path 16. However, the print control unit 40 can notify the error to the controller 30 only under the condition that any print-request signal 102 has not been received from the controller 30 for a certain time period.

In such an arrangement, the notification of the error can include information of two types; the first informs that any print-request signal 102 has not received from the controller 30 within a certain time period, and that the recording sheet is in the conveying path 16; and the second informs that any print-request signal 102 has not received from the controller 30 within a certain time period, but the recording sheet is not in the conveying path 16.

Upon receiving the error notification, the controller 30 can provide either one of the two types of information to the user, such as by displaying the notice on a control panel (not shown). Upon confirming the notification, the user can provide a print instruction after removing the sheet in the conveying path 16, if any, or immediately if no sheet is in the conveying path 16.

As described above, according to the first embodiment, the sheet-conveying process is immediately terminated if any sheet remains in the conveying path 16 upon occurrence of an error. Therefore, a paper jam can be prevented that is caused by a recording sheet in the conveying path 16 colliding with another sheet fed from the main tray 6. Thus, highly reliable printing can be achieved.

Moreover, the controller 30 notifies occurrence of an error to the user upon receiving the notification of the error from the print control unit 40 while the recording sheet is still in the conveying path 16. Therefore, the user can recognize that the error has occurred and remove the recording sheet in the conveying path 16. Thus, even when an error has occurred, the printing process can be promptly started again, reducing the time required to complete the printing.

According to the first embodiment, the sheet-conveying process is immediately terminated upon occurrence of an error, leaving a recording sheet in the conveying path 16. According to a second embodiment of the present invention, the sheet-conveying process is continued, and a recording sheet in the conveying path 16 is ejected from the image forming apparatus.

An image forming apparatus 200 according to the second embodiment is of basically the same configuration and operates in a similar manner as that of the first embodiment. Therefore, the same description is not repeated. The image forming apparatus 200 includes an image forming unit that forms a toner image, a conveyor unit that conveys recording sheets, and a printing unit that transfers and fixes the toner image onto the recording sheet (i.e., printing process). The image forming unit includes the AIO cartridges 1Bk, 1M, 1C, and 1Y, the exposing unit 2, the transfer belt 3, the driving roller 4, and the transfer-belt tension roller 5. The conveyor unit includes the main tray 6, the feed roller 7, the registration rollers 8, the registration sensor 9, the secondary transfer roller 10, the fixing unit 11, the eject rollers 12, the eject sensor 13, the double-sided printing rollers 14, the double-sided printing sensor 15, and the conveying path 16. The driving roller 4, the secondary transfer roller 10, and the fixing unit 11 also function as the printing unit.

Figure 7:
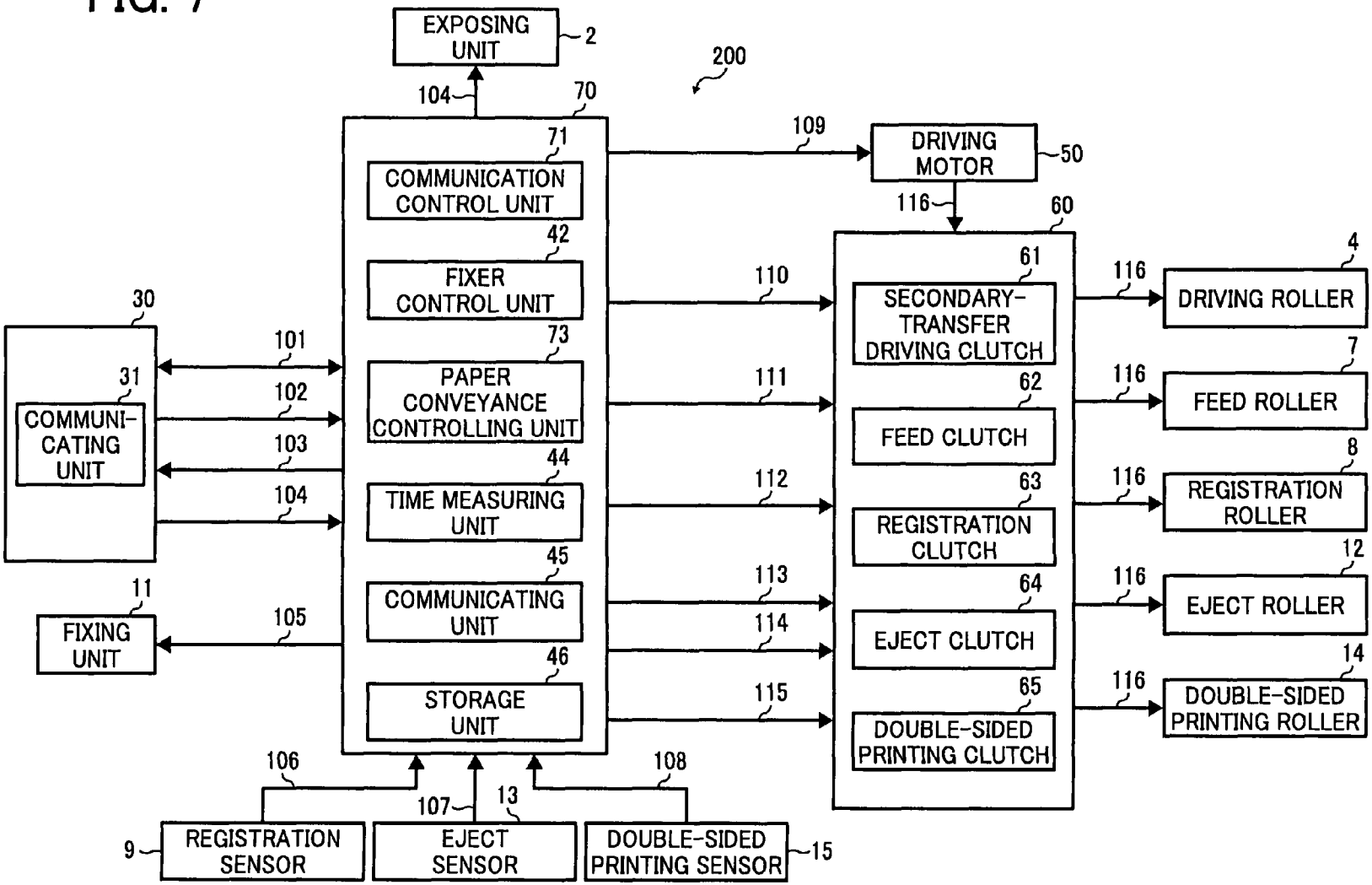
FIG. 7 is a functional block diagram of an image forming apparatus according to a second embodiment of the present invention.

FIG. 7 is a functional block diagram of the image forming apparatus 200. In FIG. 7, the image forming apparatus 200 further includes the controller 30, a print control unit 70, the driving motor 50, and the driving-force communicating unit 60.

The print control unit 70 controls the driving roller 4 in the image forming unit, the conveyor unit, and as a result, the printing unit, as well as the transmission and reception of image data to be printed. The print control unit 70 includes a communication control unit 71, a conveyor control unit 73, the time measuring unit 44, the communicating unit 45, and the storage unit 46.

The communication control unit 71 controls to receive the image data 104 from the controller 30 by transmitting the image-request signal 103, and to transmit the image data 104 from the controller 30 to the exposing unit 2 upon receiving the print-request signal 102 from the controller 30. The conveyor control unit 73 controls the on and off of the driving roller 4, the feed roller 7, the registration rollers 8, the eject rollers 12, and the double-sided printing rollers 14 based on the communicating signals 101, the print-request signal 102, and the image data 104 respectively received from the controller 30, and the registration sensor signal 106, the eject-sensor signal 107, and the double-sided sensor signal 108.

Printing Process

Figure 8A:
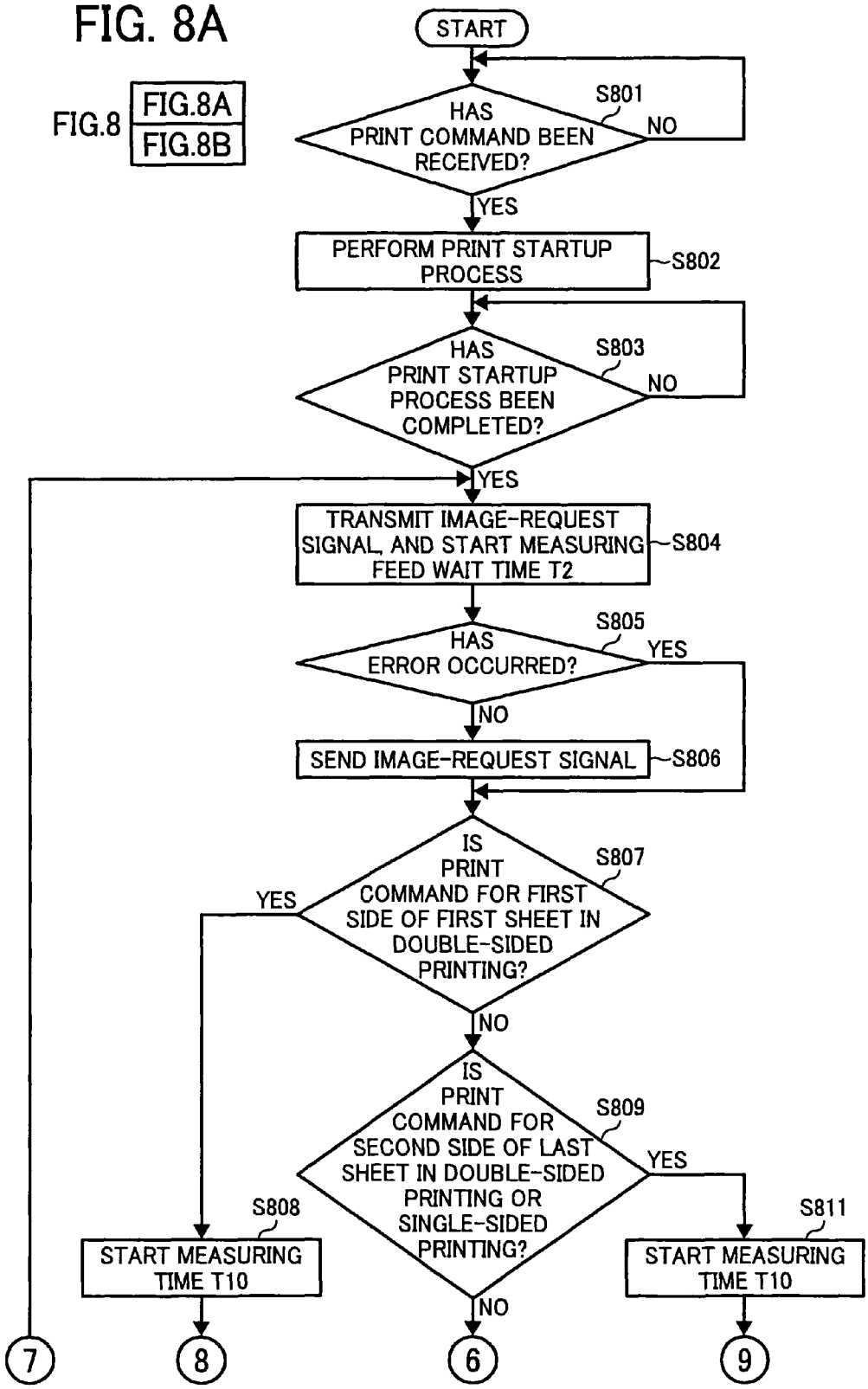
FIG. 8 is a flowchart of a printing process performed by the image forming apparatus shown in FIG. 7.
Figure 8B:
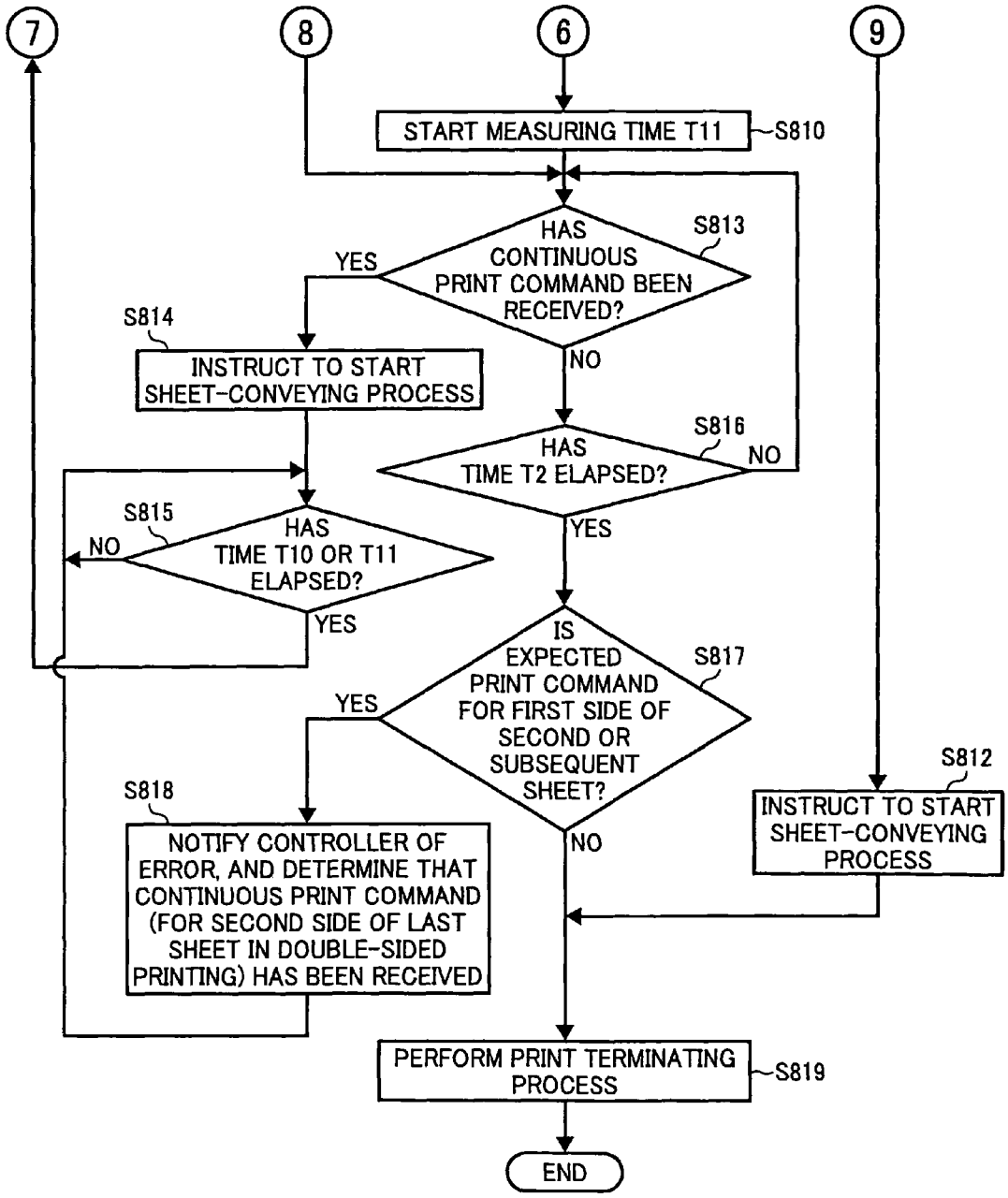

FIG. 8 is a flowchart of the printing process performed by the image forming apparatus 200. The print control unit 70 determines whether a print command has been received from the controller 30 (step S801). More specifically, the print control unit 70 determines whether the communication control unit 71 has received the print-request signal 102 from the controller 30. Step S801 is performed only when the image forming apparatus 200 in the idle state begins printing the first sheet.

If no print command has been received from the controller 30 (No at step S801), the print control unit 70 performs step S801 again after a predetermined time has elapsed. In this example, step S801 is repeated in every 2 milliseconds until receipt of a print command while the print control unit 70 is ON.

If a print command has been received from the controller 30 (Yes at step S801), the print control unit 70 performs a print startup process (step S802). More specifically, the fixer control unit 42 sends the fixer control signal 105 to the fixing unit 11, instructing the fixing unit 11 to start up, and the conveyor control unit 73 sends the motor control signal 109 to the driving motor 50, instructing the driving motor 50 to turn on.

Then, the print control unit 70 determines whether the print startup process has been completed (step S803). More specifically, the print startup process is determined to be completed if the print startup time has elapsed. The print start up time is a predefined time to complete the print startup process, and is measured by the time measuring unit 44 upon starting step S802.

If the print startup process is completed (Yes at step S803), the time measuring unit 44 start measuring the feed wait time T2 (step S804). If the print startup process is not completed (No at step S803), step S803 is performed again after a predetermined time has elapsed.

The print control unit 70 determines whether an error has occurred (step S805). If an error has occurred (Yes at step S805), the system control proceeds to a subsequent step S807. If an error has not occurred (No at step S805), the communication control unit 71 sends the image-request signal 103 to the controller 30 (step S806), and the system control proceeds to the subsequent step S807.

As a result, when an error has not occurred, the print control unit 70 receives the image data 104 from the controller 30, and sends the image data 104 to the exposing unit 2. The exposing unit 2 generates the laser beams 22Bk, 22M, 22C, and 22Y as exposure light rays based on the received image data 104. Eventually, a toner image is formed on the transfer belt 3, and transferred onto a recording sheet at a transferring (printing) step (step S906) of the sheet-conveying process shown in FIG. 9.

If an error has occurred, the print control unit 70 does not receive the image data 104 from the controller 30. Therefore, the image data 104 is not transmitted to the exposing unit 2, and the exposing unit 2 does not generates the laser beams 22Bk, 22M, 22C, and 22Y. As a result, the toner image is not transferred onto a recording sheet in the transferring (printing) step of the sheet-conveying process. This is because the system control conveys the recording sheet, which is temporarily kept in the conveying path 16 due to the occurrence of error, and ejects the recording sheet from the image forming apparatus.

At step S807, the print control unit 70 determines whether the print command received from the controller 30 is for the first side of the first sheet in the double-sided printing (step S807). More specifically, it is determined from the communicating signals 101 or the print-request signal 102 received from the controller 30.

If the print command is for the first side of the first sheet in the double-sided printing (Yes at step S807), the time measuring unit 44 sets the printing interval to T10, and start measuring time (step S808). Subsequently, the system control proceeds to step S813.

If the print command is not for the first side of the first sheet in the double-sided printing (No at step S807), the print control unit 70 further determines whether the print command is for the second side of the last sheet in the double-sided printing or for single-sided-printing (step S809).

If the print command is neither for the second side of the last sheet in the double-sided printing nor for single-sided printing (No at step S809), the time measuring unit 44 sets the printing interval to T11, and starts measuring time (step S810). Subsequently, the system control proceeds to step S813.

If the print command is for the second side of the last sheet in the double-sided printing or for single-sided printing (Yes at step S809), the time measuring unit 44 sets the printing interval to T10, and starts measuring time (step S811). Subsequently, the system control proceeds to step S812 to start the sheet-conveying process (described in detail later). After completing the sheet-conveying process, the system control proceeds to step S819.

At step S813, the print control unit 70 determines whether a next print command (continuous print command) 30 has been received from the controller (step S813). More specifically, it is determined if the communication control unit 71 has received the print-request signal 102 from the controller 30 again.

If a next print command (continuous print command) has been received from the controller 30 (Yes at step S813), the print control unit 70 performs the sheet-conveying process in a subsequent step S814. After completing the sheet-conveying process, the print control unit 40 determines whether the printing interval T10 or T11, which is measured by the time measuring unit 44, has elapsed (step S815).

If the printing interval T10 or T11 has elapsed (Yes at step S815), the system control returns to step S804 and repeats the subsequent steps. If the printing interval T10 or T11 has not elapsed (No at step S815), step S815 is performed again after a predetermined time has elapsed.

If a next print command (continuous print command) has not been received from the controller 30 (No at step S813), the print control unit 70 further determines whether the feed wait time T2, which is measured by the time measuring unit 44, has elapsed (step S816). If the feed wait time T2 has not elapsed (No at step S816), step S813 is performed again after a predetermined time has elapsed.

If the feed wait time T2 has elapsed (Yes at step S816), it is interpreted, as the print-request signal 102 not being sent from the controller 30 within a specified time, some kind of error has occurred. Therefore, a process takes place to prevent the error from causing a jam. The print control unit 70 further determines whether the expected continuous print command, which is supposed to have been received, is for the first side of the second or a subsequent sheet in double-sided printing (step S817).

If the expected continuous print command is for the first side of the second or a subsequent sheet in double-sided printing (Yes at step S817), the recording sheet printed on its first side is temporarily kept in the conveying path 16. Therefore, the print control unit 70 determines that an error has occurred and notifies the controller 30 of the error, and determines that a print command for the second side of the last sheet in the double-sided printing has been received (step S818). In this manner, the system control resets the recording sheet in the conveying path 16 to be conveyed next.

The error notification includes information that the print-request signal 102 has not received from the controller 30 within the feed wait time T2, and that the recording sheet is still in the conveying path 16. Upon receiving the error notification, the controller 30 provide a notice to the user that an error has occurred, such as by displaying the notice on a control panel (not shown), after the sheet-conveying process described later ejects the recording sheet from the conveying path 16. Unlike the first embodiment, the user is not required to remove the sheet in the conveying path 16. Therefore, after recognizing the error notification, the user can immediately providing a print instruction starting from the point where the error has occurred.

The system control proceeds to step S815. Upon completion of step S815, the system control returns to step S804, and the subsequent steps are repeated. As described above, if the print control unit 70 determines that an error has occurred at step S805, the print control unit 70 does not receive the image data 104 from the controller 30. In this manner, when an error occurs, the recording sheet is only conveyed from the conveying path 16 and ejected from the image forming apparatus, without actually transferred (printed) with the image at the transferring (printing) step of the sheet-conveying process described later. As a result, the recording sheet can be prevented from jamming in other subsequent printing processes.

If the continuous print command is not for the first side of the second or a subsequent sheet in double-sided printing (No at step S817), the sheet with its second side printed has been ejected from the image forming apparatus. Thus, there is no sheet in the conveying path 16 and no possibility for a paper jam. Then, the system control proceeds to step S819.

At step S819, the print control unit 70 performs the print terminating process. More specifically, the fixer control unit 42 sends the fixer control signal 105 to the fixing unit 11, to instruct to turn off the fixing unit 11. At the same time, the conveyor control unit 73 sends the motor control signal 109 to the driving motor 50, to instruct the driving motor 50 to turn off. The printing interval T10 or T11 may have elapsed or not elapsed before starting of the print terminating process.

Figure 9A:
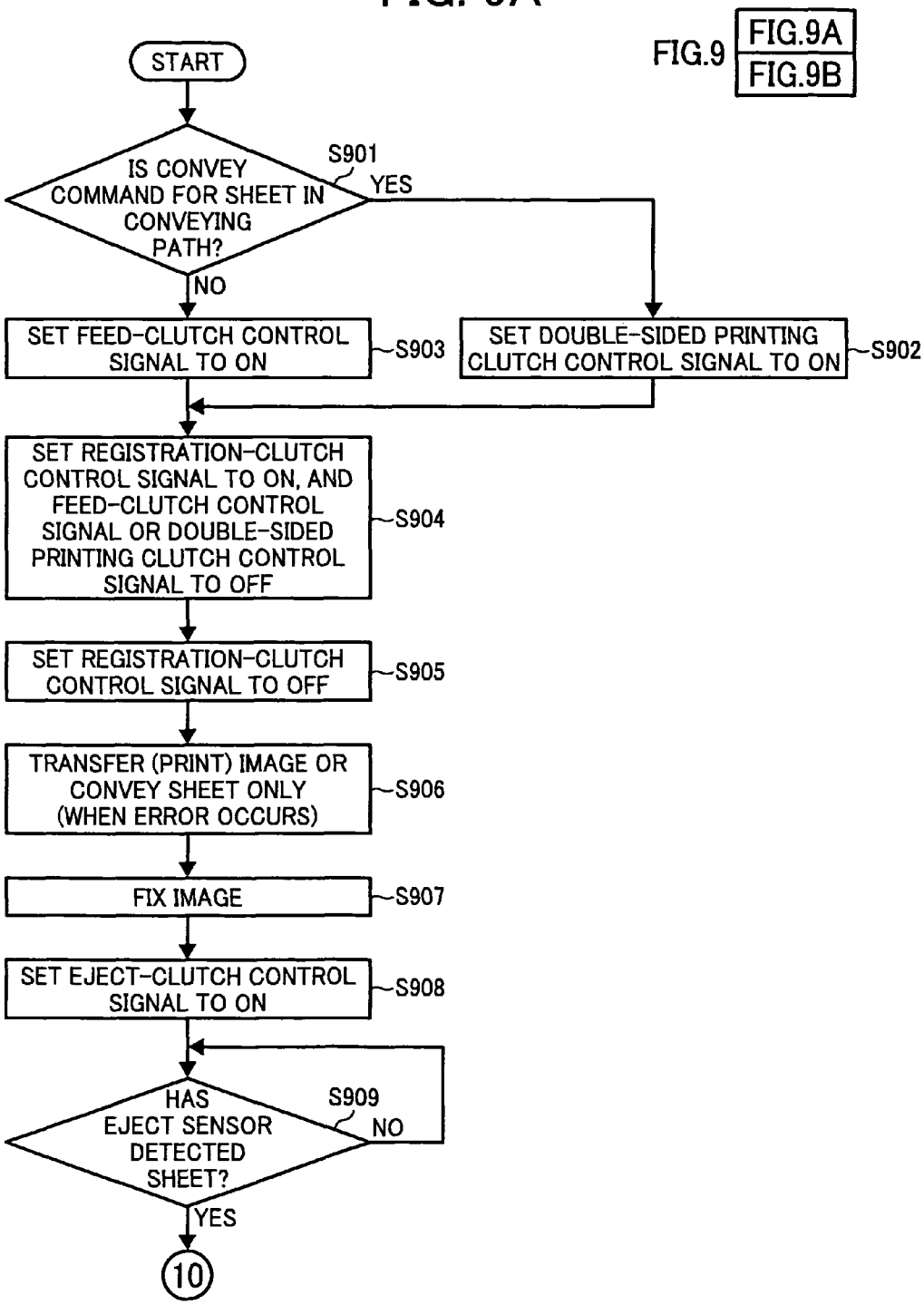
FIG. 9 is a flowchart of a sheet-conveying process performed by the image forming apparatus shown in FIG. 7.
Figure 9B:
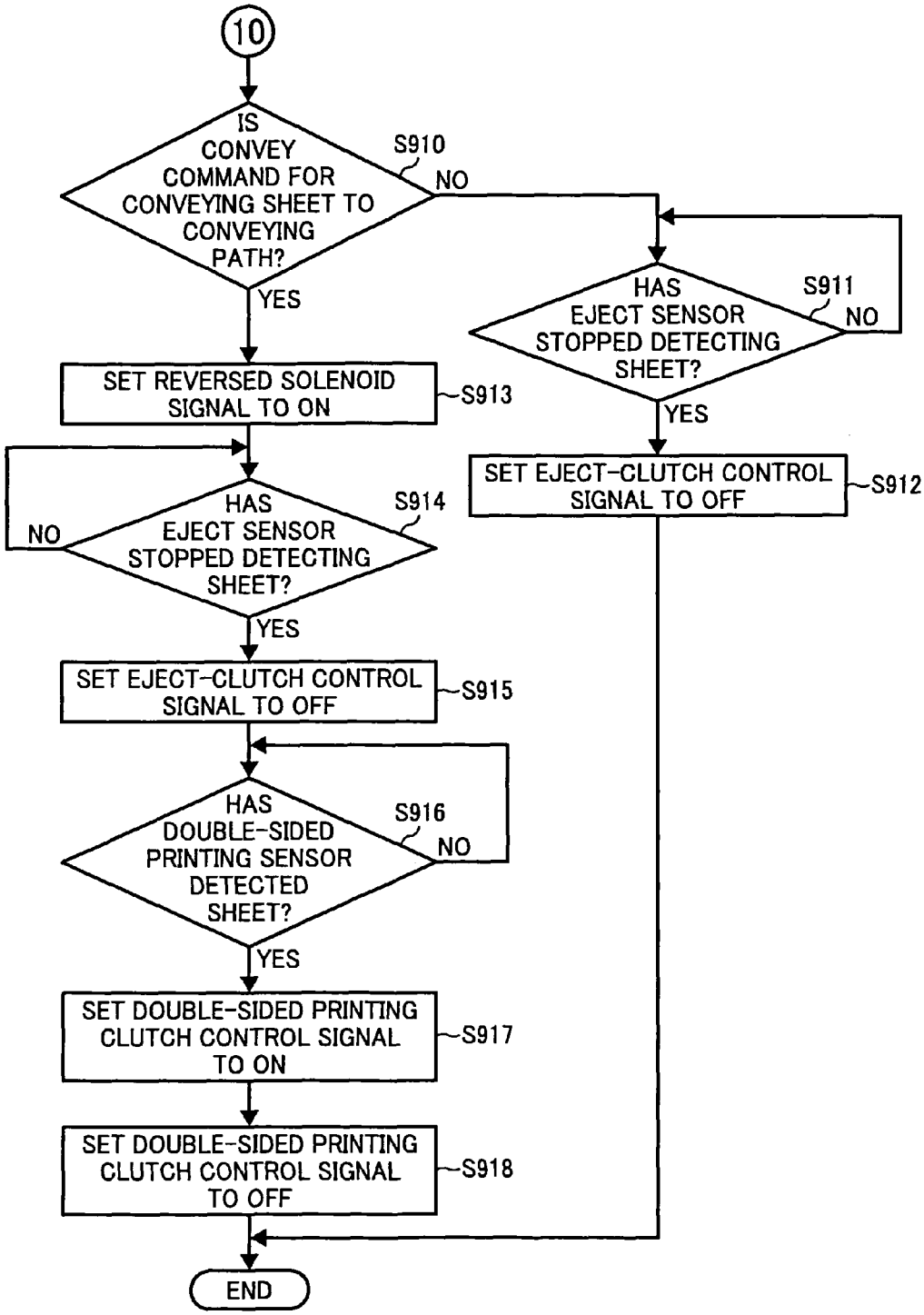

FIG. 9 is a flowchart of the sheet-conveying process performed by the image forming apparatus 200. The conveyor control unit 73 determines whether a command is issued to print the second sheet in the double-sided printing, that is, if the command is for conveying the recording sheet in the conveying path 16 (step S901).

If a command is issued for conveying the recording sheet in the conveying path 16 (Yes at step S901), the conveyor control unit 73 sets the double-sided printing clutch control signal 115 to on to instruct to turn on the double-sided printing clutch 65 (step S902). As a result, the driving force 116 of the driving motor 50 is transmitted to the double-sided printing rollers 14, the double-sided printing rollers 14 is driven in rotation, and the recording sheet is conveyed to the registration rollers 8.

If a command is not issued for conveying the recording sheet in the conveying path 16, in other words, a command is issued to feed a sheet from the main tray 6 (No at step S901), the conveyor control unit 73 sets the feed-clutch control signal 111 to on to instruct the feed clutch 62 to turn on (step S902). As a result, the driving force 116 of the driving motor 50 is transmitted to the feed roller 7, the feed roller 7 are driven in rotation, and the recording sheet is conveyed to the registration rollers 8. Upon the recording sheet reaching the registration rollers 8, the conveyor control unit 73 receives the registration sensor signal 106, indicating that the registration sensor 9 has detected a recording sheet. In this manner, the conveyor control unit 73 can recognize the exact position of the recording sheet.

If an error occurs while the sheet with its first side printed is in the conveying path 16, the print control unit 70 determines that the print command for the second side of the last sheet in the double-sided printing has been received, and the conveyor control unit 73 determines that the command is issued to convey the recording sheet from the conveying path 16.

In parallel to steps S901 to S903, the conveyor control unit 73 sets the secondary-transfer driving clutch control signal 110 to on to instruct the secondary-transfer driving clutch 61 to turn on. As a result, the driving force 116 of the driving motor 50 is transmitted to the driving roller 4, and the driving roller 4 is driven in rotation. This process causes the transfer belt 3 to rotate counterclockwise around the driving roller 4 and the transfer-belt tension roller 5. In this manner, a toner image is transferred onto the transfer belt 3 by each of the AIO cartridges 1Bk, 1M, 1C, and 1Y.

Upon the recording sheet reaching the registration rollers 8, the conveyor control unit 73 sets the registration-clutch control signal 112 to on to instruct the registration clutch 63 to turn on, and sets the double-sided printing clutch control signal 115 or the feed-clutch control signal 111 to off to instruct the double-sided printing clutch 65 or the feed clutch 62 to turn off at the timing the toner image on the transfer belt 3 is conveyed to where the tip of the recording sheet is located (step S904).

As a result, the driving force 116 of the driving motor 50 is transmitted to the registration rollers 8, and the registration rollers 8 are driven in rotation, conveying the recording sheet to the driving roller 4 and the secondary transfer roller 10. The driving force 116 of the driving motor 50 is decoupled from the double-sided printing rollers 14 or the feed roller 7, stopping the rotation of the double-sided printing rollers 14 or the feed roller 7.

Upon the recording sheet reaching the driving roller 4 and the secondary transfer roller 10, the conveyor control unit 73 sets the registration-clutch control signal 112 to off, to instruct the registration clutch 63 to turn off (step S905). As a result, the driving force 116 of the driving motor 50 is decoupled from the registration rollers 8, stopping the rotation of the registration rollers 8.

The recording sheet is conveyed between the driving roller 4 and the secondary transfer roller 10. If no error has occurred, and the toner image has been formed on the transfer belt 3 by sending the image-request signal 103 at step S806 of the printing process, the toner image formed on the transfer belt 3 is transferred (printed) onto the recording sheet by pressure applied by the rollers. If an error has occurred, step S806 of the printing process is skipped. Therefore no toner image is formed on the transfer belt 3, and the recording sheet is only conveyed. Because the sheet is only conveyed from the conveying path 16 upon occurrence of an error, the recording sheet is ejected from the image forming apparatus.

The conveyor control unit 73 provides a command to rotate the rollers in the fixing unit 11 or to other rollers (not shown), so that the rollers in the fixing unit 11 are rotated in turn to convey the recording sheet transferred or not transferred with the toner image at step S906 to the fixing unit 11. If the toner image is transferred onto the recording sheet at step S906, the toner image is fixed onto the sheet by heat and pressure applied in the fixing unit 11 (step S907). If the toner image is not transferred onto the recording sheet at step S906, the recording sheet is simply conveyed through the fixing unit 11.

The subsequent steps S908 to S918 are the same as steps S509 to S519 shown in FIG. 5, and therefore, the explanations thereof are omitted herein. Because the recording sheet in the conveying path 16 is ejected from the image forming apparatus upon occurrence of an error, the user is not even required to remove the sheet in the conveying path 16, unlike the first embodiment.

Figure 10:
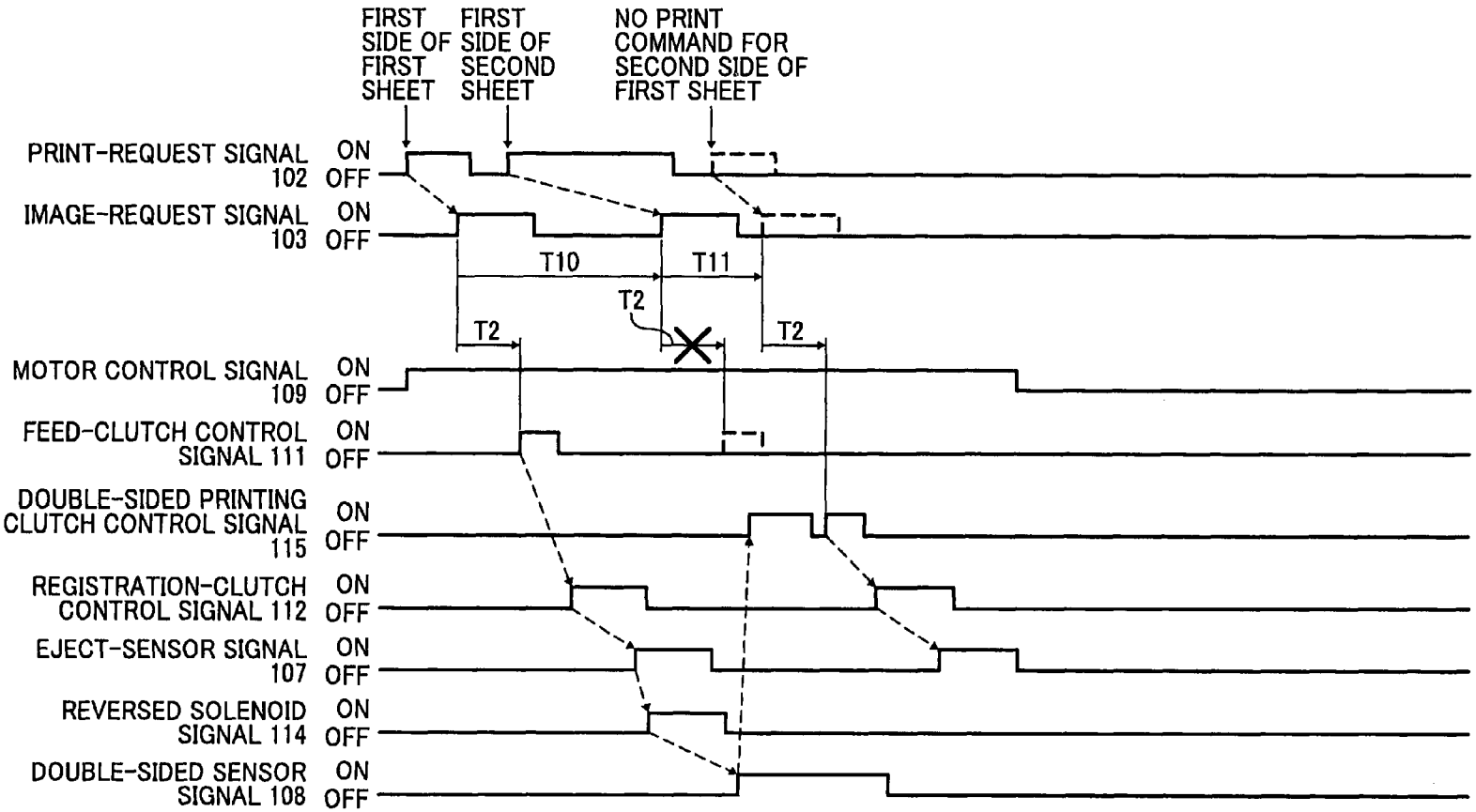
FIG. 10 is a timing chart of interleaf double-sided printing when no command to print the second side of the first sheet is issued from a controller shown in FIG. 7.

FIG. 10 is a timing chart used in the interleaf double-sided printing when the print control unit 70 did not receive a command to print the second side of the first sheet from the controller 30 before the feed wait time T2 has elapsed.

The print control unit 70 considers such a condition as an occurrence of an error, and stops conveying the second sheet from the main tray 6. In other words, the print control unit 70 stops the printing process for the first side of the second sheet. In addition, the first sheet of the recording sheet in the conveying path 16 is ejected from the image forming apparatus, by sequentially setting the double-sided printing clutch control signal 115, the registration-clutch control signal 112, and the eject-clutch control signal 113 (not shown) to on. Therefore, the first sheet of the recording sheet can be prevented from being collided by the second sheet fed into the conveying path 16 after printing process, which prevents a jam. Furthermore, unlike the first embodiment, the user is not required to remove the sheet from the conveying path 16, because the sheet is automatically ejected from the image forming apparatus. The controller 30 can recognize that the printing process for the first side of the second sheet has been aborted, because the controller 30 is notified of occurrence of the error from the print control unit 70.

According to the second embodiment, if the sheet with its first side printed is still in the conveying path 16 upon occurrence of an error, the usual sheet-conveying process is performed to eject the recording sheet from the image forming apparatus 200. Alternatively, the double-sided printing rollers 14 may be rotated in the reverse direction to eject the sheet in the conveying path 16 from the image forming apparatus, without using other rollers such as the registration rollers 8.

As described above, according to the second embodiment a recording sheet, if any, is ejected if an error occurs while the recording sheet is still in the conveying path 16. With this, the image forming apparatus only performs the normal sheet-conveying process without performing the printing operation. Therefore, the recording sheet in the conveying path 16 can be prevented from being collided by the recording sheet separately fed from the main tray 6 into the conveying path 16, which prevents a jam. Moreover, unlike the first embodiment, the user is not required to remove the sheet from the conveying path 16. Therefore, highly reliable printing can be achieved.

Moreover, the recording sheet is ejected by rotating the double-sided printing rollers 14 in the reverse direction. This also prevents the recording sheet from being collided by the recording sheet separately fed from the main tray 6 into the conveying path 16, thereby preventing a jam.

Figure 11:
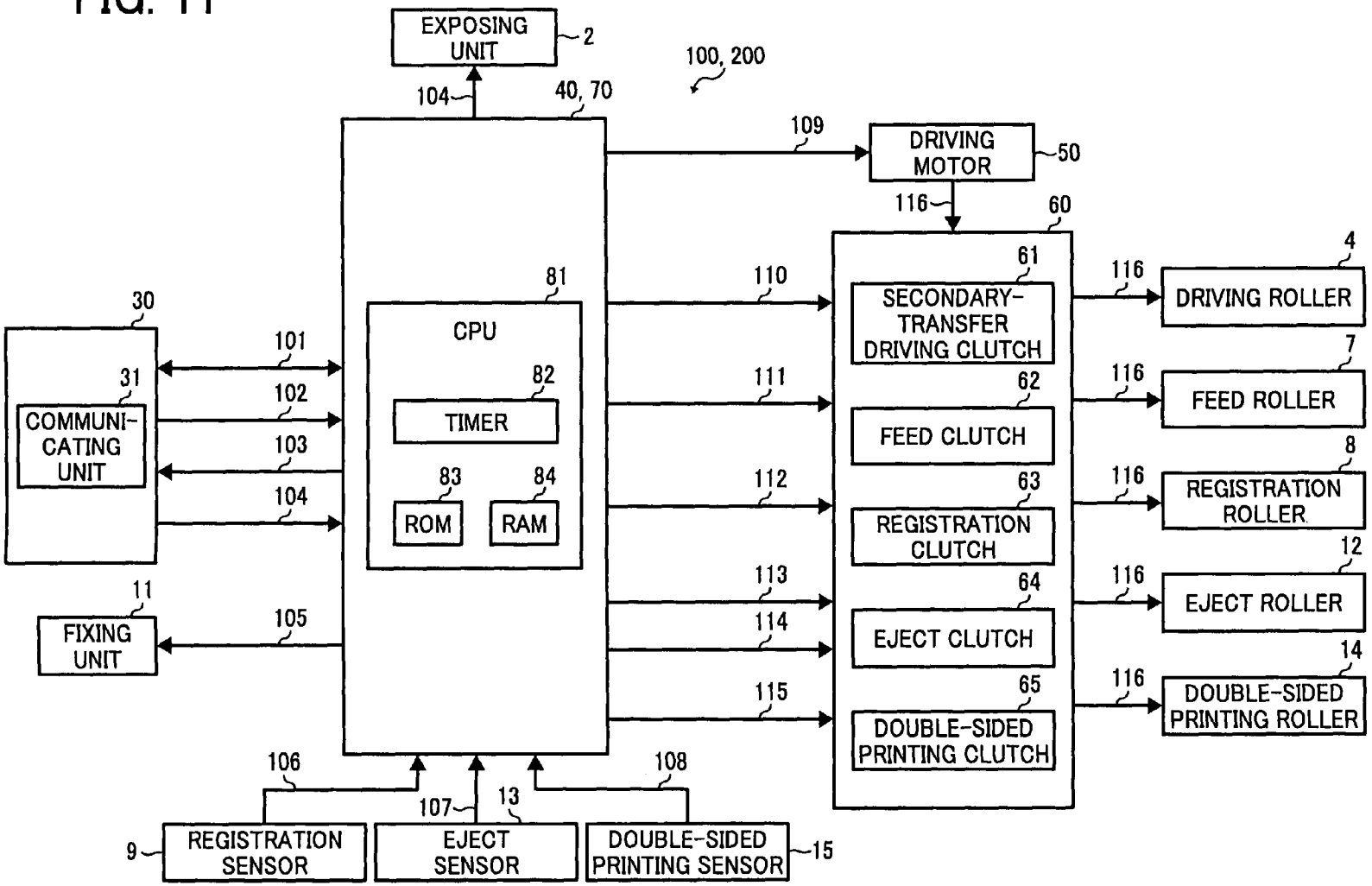
FIG. 11 is a block diagram of a hardware configuration of the image forming apparatus.

FIG. 11 is a block diagram of a hardware configuration of the print control unit in the image forming apparatus according to the embodiments of the present invention. The print control unit 40 or 70 includes a central processing unit (CPU) 81, a timer 82, a read-only memory (ROM) 83, and a random access memory (RAM) 84. The CPU 81 implements each function of the communication control unit 41 or 71, the fixer control unit 42, the conveyor control unit 43 or 73, and the communicating unit 45. The timer 82 is used for measuring the printing intervals T10 and T11, the feed wait time T2, and the print startup time, which are measured as a function of the time measuring unit 44, or to measure 2 milliseconds at step S401 shown in FIG. 4 or at step S801 shown in FIG. 8. The ROM 83 is a read-only storage device that stores therein a computer program and so on, and the RAM 84 is the main memory of the CPU 81.

A computer program (hereinafter, "print-control program") can be performed on a computer to realize the same function as the image forming apparatus 100 or 200. The print-control program can be provided as being stored in a computer-readable storage device such as a compact disc read only memory (CD-ROM), a flexible disk (FD), a compact disc recordable (CD-R), and a digital versatile disk (DVD) as a file in an installable or executable format, or can be stored in a storage device such as a ROM in advance.

The print-control program can also be stored in another computer connected to the computer via a network such as the Internet so that the programs can be downloaded therefrom. The print-control program can also be provided or distributed via a network such as the Internet.

As set forth hereinabove, according to an embodiment of the present invention, maintenance work is easy or is not necessary, and highly reliable printing can be achieved.

Moreover, fast reprint is performed after occurrence of an error, which reduces the time required for printing.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that forms a toner image based on image data;

a conveyor unit that conveys a transfer medium onto which the toner image is to be transferred;

a printing unit that prints the toner image onto the transfer medium;

a detecting unit that detects a print command for each image including information on printing mode, the printing mode including single-sided printing and double-sided printing;

a data acquiring unit that acquires, when the detecting unit detects a print command for an image, image data of the image, and outputs the image data to the image forming unit;

a first control unit that controls the conveyor unit to feed a transfer medium from a feed tray to the printing unit in response to a first print command for printing a first side of the transfer medium by double-sided printing, and to feed the transfer medium to the printing unit from a conveying path, where the transfer medium is temporarily kept after the first side is printed, in response to a second print command for printing a second side of a previous transfer medium by double-sided printing; and a second control unit that controls the conveyor unit to convey the transfer medium to the conveying path after the first side of the transfer medium is printed, and to eject the previous transfer medium after the second side of the previous transfer medium is printed, wherein the first control unit controls the conveyor unit to halt the feed operation of the transfer medium from the feed tray to the printing unit when the detecting unit does not detect the second print command on the previous transfer medium within a predetermined time after detecting the first print command.

2. The image forming apparatus according to claim 1, wherein, when a first side of at least one transfer medium has been printed by double-sided printing, the data acquiring unit outputs no image data to the image forming unit;

the first control unit controls the conveyor unit to feed a transfer medium to the printing unit from the conveying path; and the second control unit controls the conveyor unit to eject the transfer medium from the printing unit to outside.

3. The image forming apparatus according to claim 1, wherein, when a first side of at least one transfer medium has been printed by double-sided printing, the second control unit controls the conveyor unit to eject a transfer medium from the conveying path to outside.

4. The image forming apparatus according to claim 1, further comprising a notifying unit that notifies that an error has occurred when the detecting unit does not detect the second print command within a predetermined time after detecting the first print command.

5. A print control method applied to an image forming apparatus that includes an image forming unit that forms a toner image based on image data, a conveyor unit that conveys a transfer medium onto which the toner image is to be transferred, and a printing unit that prints the toner image onto the transfer medium, the print control method comprising:

detecting a print command for each image including information on printing mode, the printing mode including single-sided printing and double-sided printing;

acquiring, upon detection of a print command for an image, image data of the image to output the image data to the image forming unit;

first controlling the conveyor unit to feed a transfer medium from a feed tray to the printing unit in response to a first print command for printing a first side of the transfer medium by double-sided printing, and to feed the transfer medium to the printing unit from a conveying path, where the transfer medium is temporarily kept after the first side is printed, in response to a second print command for printing a second side of a previous transfer medium by double-sided printing; and second controlling the conveyor unit to convey the transfer medium to the conveying path after the first side of the transfer medium is printed, and to eject the transfer medium after the second side of the previous transfer medium is printed, wherein the first controlling includes controlling the conveyor unit to halt the feed operation of the transfer medium from the feed tray to the printing unit when the second print command on the previous transfer medium is not detected within a predetermined time after detection of the first print command.

6. The print control method according to claim 5, wherein, when a first side of at least one transfer medium has been printed by double-sided printing, no image data is output to the image forming unit at the acquiring;

a transfer medium is fed to the printing unit from the conveying path at the first controlling; and the transfer medium is ejected from the printing unit to outside at the second controlling.

7. The print control method according to claim 5, further comprising third controlling the conveyor unit to eject a transfer medium from the conveying path to outside when a first side of at least one transfer medium has been printed by double-sided printing.

8. The print control method according to claim 5, further comprising notifying that an error has occurred when the second print command is not detected within a predetermined time after detection of the first print command.

9. A non-transitory computer-readable recording medium that stores therein a computer program that causes a computer to implement a print control method on an image forming apparatus that includes an image forming unit that forms a toner image based on image data, a conveyor unit that conveys a transfer medium onto which the toner image is to be transferred, and a printing unit that prints the toner image onto the transfer medium, the computer program causing the computer to execute:

detecting a print command for each image including information on printing mode, the printing mode including single-sided printing and double-sided printing;

acquiring, upon detection of a print command for an image, image data of the image to output the image data to the image forming unit;

first controlling the conveyor unit to feed a transfer medium from a feed tray to the printing unit in response to a first print command for printing a first side of the transfer medium by double-sided printing, and to feed the transfer medium to the printing, unit from a conveying path, where the transfer medium is temporarily kept after the first side is printed, in response to a second print command for printing a second side of a previous transfer medium by double-sided printing; and second controlling the conveyor unit to convey the transfer medium to the conveying path after the first side of the transfer medium is printed, and to eject the previous transfer medium after the second side of the previous transfer medium is printed, wherein the first controlling includes controlling the conveyor unit to halt the feed operation of the transfer medium from the feed tray to the printing unit when the second print command on the previous transfer medium is not detected within a predetermined time after detection of the first print command.

10. The non-transitory computer-readable recording medium according to claim 9, wherein, when a first side of at least one transfer medium has been printed by double-sided printing, no image data is output to the image forming unit at the acquiring;

a transfer medium is fed to the printing unit from the conveying path at the first controlling; and the transfer medium is ejected from the printing unit to outside at the second controlling.

11. The non-transitory computer-readable recording medium according to claim 9, the computer program further causing the computer to execute third controlling the conveyor unit to eject a transfer medium from the conveying path to outside when a first side of at least one transfer medium has been printed by double-sided printing.

12. The non-transitory computer-readable recording medium according to claim 9, the computer program further causing the computer to execute notifying that an error has occurred when the second print command is not detected within a predetermined time after detection of the first print command.

* * * * *